US010843480B2

(12) United States Patent
Arai et al.

(10) Patent No.: US 10,843,480 B2
(45) Date of Patent: Nov. 24, 2020

(54) INKJET PRINTING APPARATUS AND CONTROL METHOD OF INKJET PRINTING APPARATUS

(71) Applicant: CANON KABUSHIKI KAISHA, Tokyo (JP)

(72) Inventors: Ryoma Arai, Kawasaki (JP); Tsuyoshi Saeki, Kawasaki (JP); Toshiaki Tokisawa, Kawasaki (JP); Junya Kosuge, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/271,255

(22) Filed: Feb. 8, 2019

(65) Prior Publication Data

US 2019/0263136 A1 Aug. 29, 2019

(30) Foreign Application Priority Data

Feb. 23, 2018 (JP) ..... 2018-030838
Sep. 10, 2018 (JP) ..... 2018-168942

(51) Int. Cl.
*B41J 2/175* (2006.01)
*B41J 2/18* (2006.01)
*B41J 29/38* (2006.01)

(52) U.S. Cl.
CPC ..... *B41J 2/17596* (2013.01); *B41J 2/175* (2013.01); *B41J 2/18* (2013.01); *B41J 29/38* (2013.01)

(58) Field of Classification Search
CPC ..... B41J 2/17596; B41J 29/38; B41J 2/175; B41J 2/18
See application file for complete search history.

(56) References Cited

U.S. PATENT DOCUMENTS

| | | | | |
|---|---|---|---|---|
| 8,733,908 | B2 | 5/2014 | Borra et al. | |
| 2006/0132554 | A1* | 6/2006 | Ota | B41J 2/17556 347/85 |
| 2006/0157515 | A1* | 7/2006 | Oswald | B67D 1/07 222/399 |
| 2007/0206050 | A1* | 9/2007 | Morgan | B41J 2/155 347/42 |
| 2010/0079562 | A1* | 4/2010 | Katada | B41J 2/175 347/85 |
| 2019/0009565 | A1 | 1/2019 | Kosuge et al. | |

* cited by examiner

*Primary Examiner* — Yaovi M Ameh
(74) *Attorney, Agent, or Firm* — Venable LLP

(57) ABSTRACT

An inkjet printing apparatus includes: a print head provided with an ejection opening surface; a tank; a supply flow path; a collection flow path; an intra-tank vacuum pump to reduce pressure inside the tank; and a control unit. The control unit performs a first operation and a second operation, the first operation causing the intra-tank vacuum pump to operate while a collection drive valve is closed, so as to pull out ink in a flow path which extends from the ejection opening to the supply flow path into the tank, the second operation causing the intra-tank vacuum pump to operate while a supply drive valve is closed, so as to pull out ink in a flow path which extends from the ejection opening to the collection flow path into the tank.

15 Claims, 22 Drawing Sheets

INKJET PRINTING APPARATUS AND CONTROL METHOD OF INKJET PRINTING APPARATUS

BACKGROUND OF THE INVENTION

Field of the Invention

The present invention relates to an inkjet printing apparatus and a control method of the inkjet printing apparatus.

Description of the Related Art

An inkjet printing apparatus in which a circulation flow path connecting a print head and an ink container is adopted is known. Specification of U.S. Pat. No. 8,733,908 (hereinafter referred to as Document 1) discloses an inkjet printing apparatus including a print head 200, a print fluid line 380 serving as a flow path on the upstream side of the print head 200, and a closed loop 348 serving as a flow path on the downstream side of the print head 200 (numerals in Document 1 are attached for reference). Furthermore, a pump 378 for ink circulation is disposed in the flow path on the downstream side of the print head 200. Further, a valve 386 for controlling whether to stop ink circulation is disposed in the flow path on the upstream side of the print head 200. The valve 386 is also connected to a vent line 392 serving as an atmosphere communication path and is capable of controlling whether to release the atmosphere communication path. With such a configuration, Document 1 discloses that, in a case of detaching the print head 200, ink remaining in the flow path and the print head 200 is pulled out into the ink container. Specifically, it is described that an end of the flow path is released to the atmosphere and ink in the flow path and the print head 200 is pulled out into the ink container by use of the pump 378 used for circulation.

However, in Document 1, there may be a case of requiring time for the process of pulling out ink into the ink container or a case of occurrence of remaining ink. For example, in a case where the pump 378 used for circulation has low output power or in a case where resistance of the flow path is large because the circulation flow path has a long flow path length or has a short flow path diameter, there may be a case of requiring time for the process or a case of occurrence of remaining ink. Furthermore, in Document 1, there is a possibility of occurrence of remaining ink in the head because a process of pulling out ink in one direction of the flow path is performed.

SUMMARY OF THE INVENTION

The inkjet printing apparatus according to an embodiment of the present invention includes: a print head provided with an ejection opening on which an ejection opening for ink is formed; a tank configured to contain ink to be supplied to the print head; a supply flow path configured to supply ink from the tank to the print head; a collection flow path configured to collect ink from the print head to the tank; a supply drive valve capable of opening and closing the supply flow path; a collection drive valve capable of opening and closing the collection flow path; an intra-tank vacuum pump configured to reduce pressure inside the tank; and a control unit configured to control the supply drive valve, the collection drive valve, and the intra-tank vacuum pump, wherein the control unit is configured to perform a first operation and a second operation, the first operation causing the intra-tank vacuum pump to operate while the collection drive valve is closed, so as to pull out ink in a flow path which extends from the ejection opening to the supply flow path into the tank, the second operation causing the intra-tank vacuum pump to operate while the supply drive valve is closed, so as to pull out ink in a flow path which extends from the ejection opening to the collection flow path into the tank.

Further features of the present invention will become apparent from the following description of exemplary embodiments with reference to the attached drawings.

DESCRIPTION OF THE EMBODIMENTS

Figure 1:
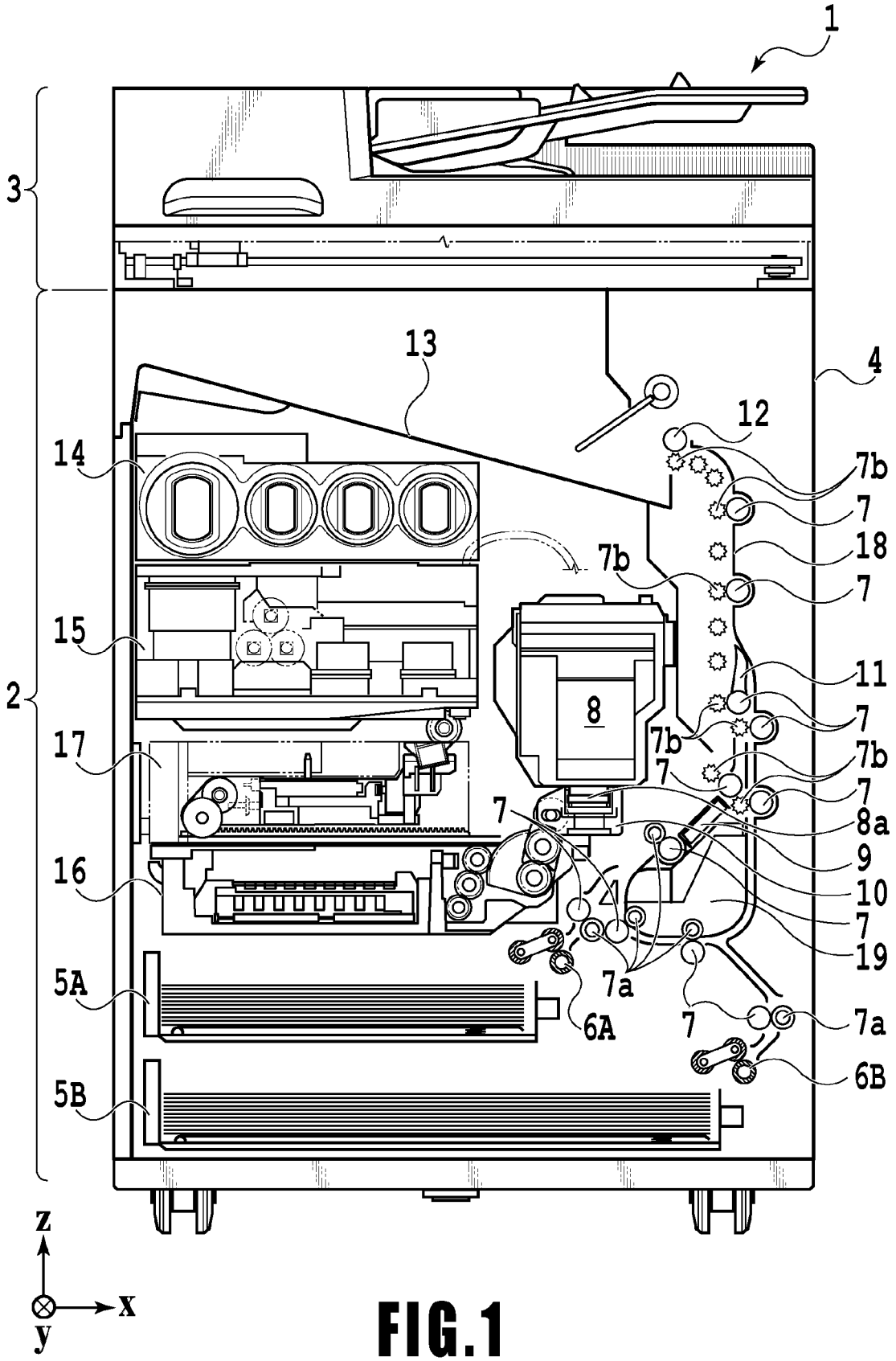
FIG. 1 is a diagram showing a printing apparatus in a standby state.

Embodiments of the present invention will be described below with reference to the drawings. It should be noted that the following embodiments do not limit the present invention and that not all of the combinations of the characteristics described in the present embodiments are essential for solving the problem to be solved by the present invention. Incidentally, the same reference numeral refers to the same component in the following descriptions. Furthermore, relative positions, shapes, and the like of the constituent elements described in the embodiments are exemplary only and are not intended to limit the scope of the invention.

First Embodiment

FIG. 1 is an internal configuration diagram of an inkjet printing apparatus 1 (hereinafter "printing apparatus 1")

used in the present embodiment. In the drawings, an x-direction is a horizontal direction, a y-direction (a direction perpendicular to paper) is a direction in which ejection openings are arrayed in a print head 8 described later, and a z-direction is a vertical direction.

The printing apparatus 1 is a multifunction printer comprising a print unit 2 and a scanner unit 3. The printing apparatus 1 can use the print unit 2 and the scanner unit 3 separately or in synchronization to perform various processes related to print operation and scan operation. The scanner unit 3 comprises an automatic document feeder (ADF) and a flatbed scanner (FBS) and is capable of scanning a document automatically fed by the ADF as well as scanning a document placed by a user on a document plate of the FBS. The present embodiment is directed to the multifunction printer comprising both the print unit 2 and the scanner unit 3, but the scanner unit 3 may be omitted. FIG. 1 shows the printing apparatus 1 in a standby state in which neither print operation nor scan operation is performed.

In the print unit 2, a first cassette 5A and a second cassette 5B for housing a print medium (cut sheet) S are detachably provided at the bottom of a casing 4 in the vertical direction. A relatively small print medium of up to A4 size is placed flat and housed in the first cassette 5A and a relatively large print medium of up to A3 size is placed flat and housed in the second cassette 5B. A first feeding unit 6A for sequentially feeding a housed print medium is provided near the first cassette 5A. Similarly, a second feeding unit 6B is provided near the second cassette 5B. In print operation, a print medium S is selectively fed from either one of the cassettes.

Conveying rollers 7, a discharging roller 12, pinch rollers 7*a*, spurs 7*b*, a guide 18, an inner guide 19, and a flapper 11 are conveying mechanisms for guiding a print medium S in a predetermined direction. The conveying rollers 7 are drive rollers located upstream and downstream of the print head 8 and driven by a conveying motor (not shown). The pinch rollers 7*a* are follower rollers that are turned while nipping a print medium S together with the conveying rollers 7. The discharging roller 12 is a drive roller located downstream of the conveying rollers 7 and driven by the conveying motor (not shown). The spurs 7*b* nip and convey a print medium S together with the conveying rollers 7 and discharging roller 12 located downstream of the print head 8.

The guide 18 is provided in a conveying path of a print medium S to guide the print medium S in a predetermined direction. The inner guide 19 is a member extending in the y-direction. The inner guide 19 has a curved side surface and guides a print medium S along the side surface. The flapper 11 is a member for changing a direction in which a print medium S is conveyed in duplex print operation. A discharging tray 13 is a tray for placing and housing a print medium S that was subjected to print operation and discharged by the discharging roller 12.

The print head 8 of the present embodiment is a full line type color inkjet print head. In the print head 8, a plurality of ejection openings configured to eject ink based on print data are arrayed in the y-direction in FIG. 1 so as to correspond to the width of a print medium S. In a case where the print head 8 is in a standby position, an ejection opening surface 8*a* of the print head 8 is oriented vertically downward and capped with a cap unit 10 as shown in FIG. 1. In print operation, the orientation of the print head 8 is changed by a print controller 202 described later such that the ejection opening surface 8*a* faces a platen 9. The platen 9 includes a flat plate extending in the y-direction and supports, from the back side, a print medium S subjected to print operation by the print head 8. The movement of the print head 8 from the standby position to a printing position will be described later in detail.

An ink tank unit 14 separately stores ink of four colors to be supplied to the print head 8. An ink supply unit 15 is provided in the midstream of a flow path connecting the ink tank unit 14 to the print head 8 to adjust the pressure and flow rate of ink in the print head 8 within a suitable range. The present embodiment adopts a circulation type ink supply system, where the ink supply unit 15 adjusts the pressure of ink supplied to the print head 8 and the flow rate of ink collected from the print head 8 within a suitable range.

A maintenance unit 16 comprises the cap unit 10 and a wiping unit 17 and activates them at predetermined timings to perform maintenance operation for the print head 8.

Figure 2:
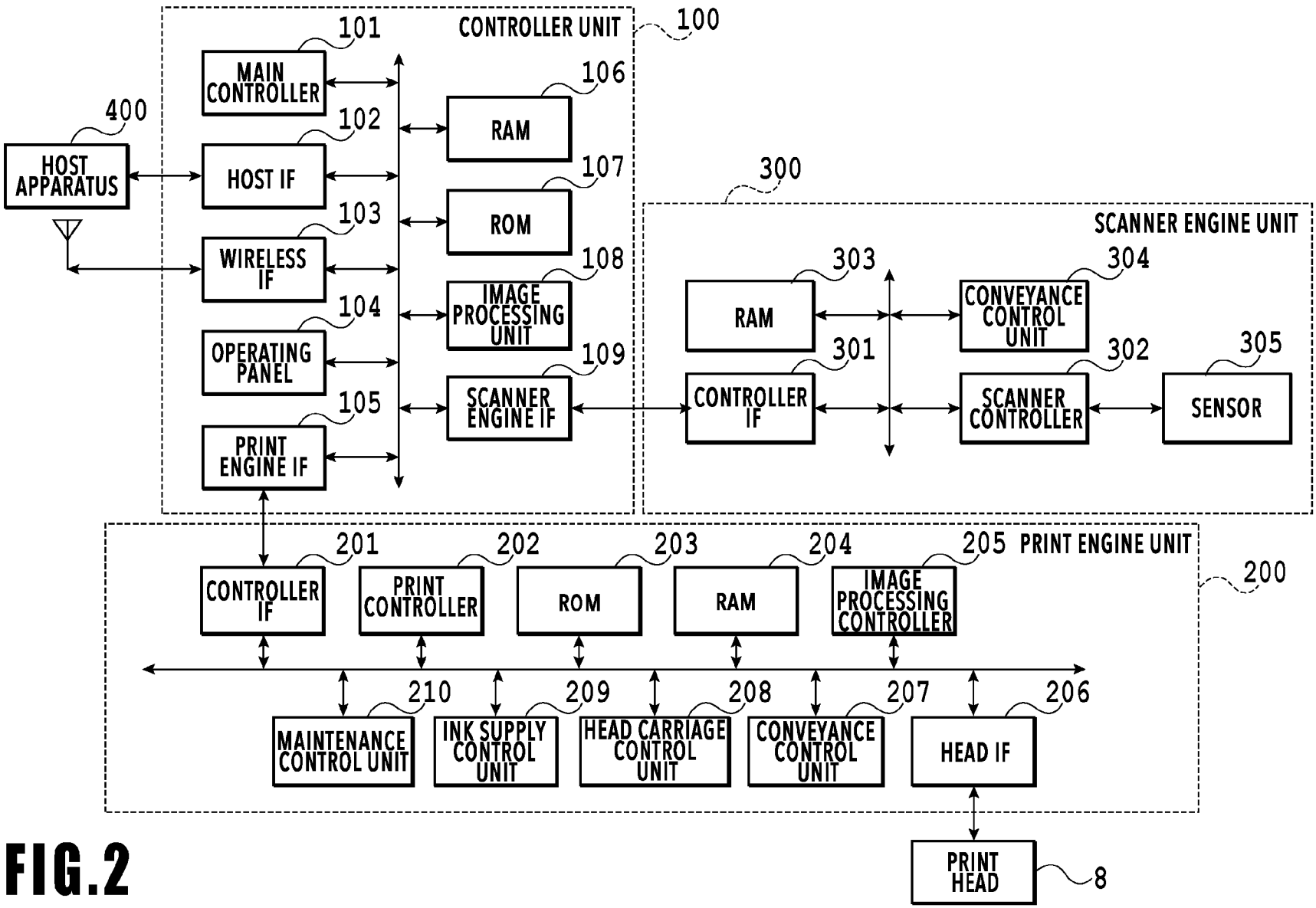
FIG. 2 is a control configuration diagram of the printing apparatus.

FIG. 2 is a block diagram showing a control configuration in the printing apparatus 1. The control configuration mainly includes a print engine unit 200 that exercises control over the print unit 2, a scanner engine unit 300 that exercises control over the scanner unit 3, and a controller unit 100 that exercises control over the entire printing apparatus 1. A print controller 202 controls various mechanisms of the print engine unit 200 under instructions from a main controller 101 of the controller unit 100. Various mechanisms of the scanner engine unit 300 are controlled by the main controller 101 of the controller unit 100. The control configuration will be described below in detail.

In the controller unit 100, the main controller 101 including a CPU controls the entire printing apparatus 1 using a RAM 106 as a work area in accordance with various parameters and programs stored in a ROM 107. For example, in a case where a print job is input from a host apparatus 400 via a host I/F 102 or a wireless I/F 103, an image processing unit 108 executes predetermined image processing for received image data under instructions from the main controller 101. The main controller 101 transmits the image data subjected to the image processing to the print engine unit 200 via a print engine I/F 105.

The printing apparatus 1 may acquire image data from the host apparatus 400 via a wireless or wired communication or acquire image data from an external storage unit (such as a USB memory) connected to the printing apparatus 1. A communication system used for the wireless or wired communication is not limited. For example, as a communication system for the wireless communication, Wi-Fi (Wireless Fidelity; registered trademark) and Bluetooth (registered trademark) can be used. As a communication system for the wired communication, a USB (Universal Serial Bus) and the like can be used. For example, if a scan command is input from the host apparatus 400, the main controller 101 transmits the command to the scanner unit 3 via a scanner engine I/F 109.

An operating panel 104 is a mechanism to allow a user to do input and output for the printing apparatus 1. A user can give an instruction to perform operation such as copying and scanning, set a print mode, and recognize information about the printing apparatus 1 via the operating panel 104.

In the print engine unit 200, the print controller 202 including a CPU controls various mechanisms of the print unit 2 using a RAM 204 as a work area in accordance with various parameters and programs stored in a ROM 203. Once various commands and image data are received via a controller I/F 201, the print controller 202 temporarily stores them in the RAM 204. The print controller 202 allows an image processing controller 205 to convert the stored image data into print data such that the print head 8 can use it for print operation. After the generation of the print data, the print controller 202 allows the print head 8 to perform print operation based on the print data via a head I/F 206. At this time, the print controller 202 conveys a print medium S by driving the feeding units 6A and 6B, conveying rollers 7, discharging roller 12, and flapper 11 shown in FIG. 1 via a conveyance control unit 207. The print head 8 performs print operation in synchronization with the conveyance operation of the print medium S under instructions from the print controller 202, thereby performing printing.

A head carriage control unit 208 changes the orientation and position of the print head 8 in accordance with an operating state of the printing apparatus 1 such as a maintenance state or a printing state. An ink supply control unit 209 controls the ink supply unit 15 such that the pressure of ink supplied to the print head 8 is within a suitable range. A maintenance control unit 210 controls the operation of the cap unit 10 and wiping unit 17 in the maintenance unit 16 at the time of performing maintenance operation for the print head 8.

In the scanner engine unit 300, the main controller 101 controls hardware resources of the scanner controller 302 using the RAM 106 as a work area in accordance with various parameters and programs stored in the ROM 107, thereby controlling various mechanisms of the scanner unit 3. For example, the main controller 101 controls hardware resources in the scanner controller 302 via a controller I/F 301 to cause a conveyance control unit 304 to convey a document placed by a user on the ADF and cause a sensor 305 to scan the document. The scanner controller 302 stores scanned image data in a RAM 303. The print controller 202 can convert the image data acquired as described above into print data to enable the print head 8 to perform print operation based on the image data scanned by the scanner controller 302.

Figure 3:
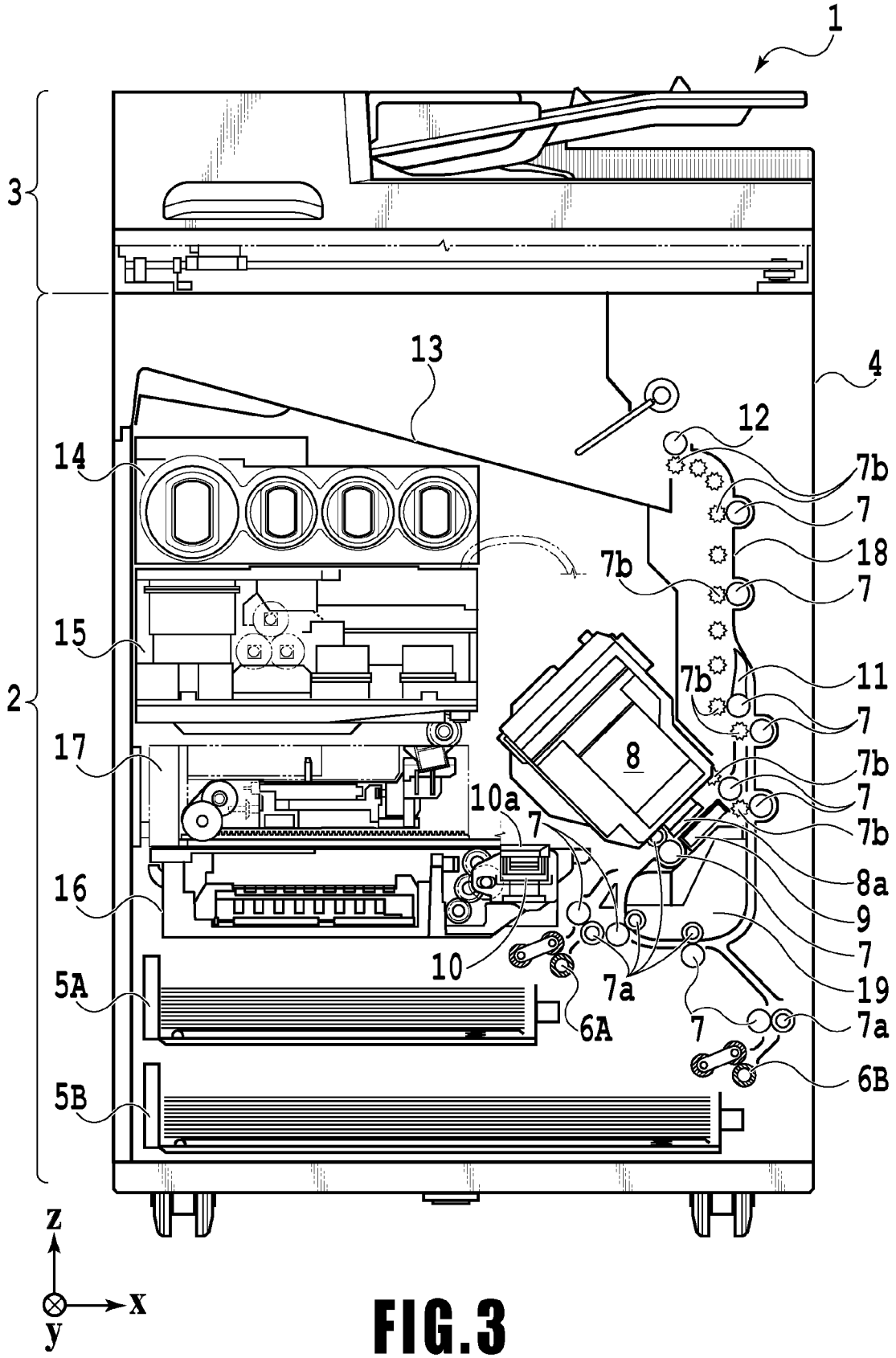
FIG. 3 is a diagram showing the printing apparatus in a printing state.

FIG. 3 shows the printing apparatus 1 in a printing state. As compared with the standby state shown in FIG. 1, the cap unit 10 is separated from the ejection opening surface 8*a* of the print head 8 and the ejection opening surface 8*a* faces the platen 9. In the present embodiment, the plane of the platen 9 is inclined at about 45° with respect to the horizontal plane. The ejection opening surface 8*a* of the print head 8 in a printing position is also inclined at about 45° with respect to the horizontal plane so as to keep a constant distance from the platen 9.

In the case of moving the print head 8 from the standby position shown in FIG. 1 to the printing position shown in FIG. 3, the print controller 202 uses the maintenance control unit 210 to move the cap unit 10 down to an evacuation position shown in FIG. 3, thereby separating the cap member 10*a* from the ejection opening surface 8*a* of the print head 8. The print controller 202 then uses the head carriage control unit 208 to turn the print head 8 by 45° while adjusting the vertical height of the print head 8 such that the ejection opening surface 8*a* faces the platen 9. After the completion of print operation, the print controller 202 reverses the above procedure to move the print head 8 from the printing position to the standby position.

Figure 4:
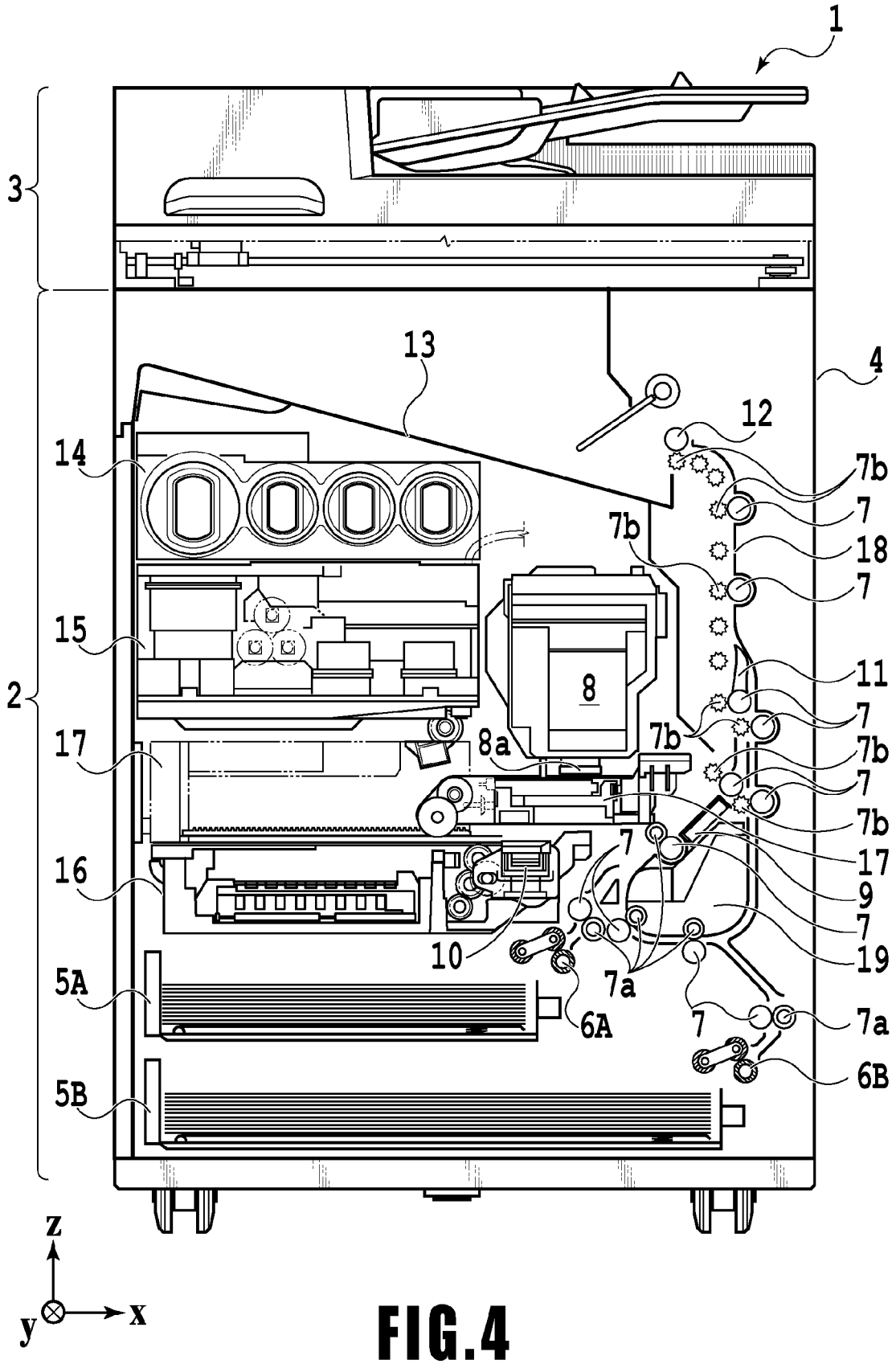
FIG. 4 is a diagram showing the printing apparatus in a maintenance state.

FIG. 4 is a diagram showing the printing apparatus 1 in a maintenance state. In the case of moving the print head 8 from the standby position shown in FIG. 1 to a maintenance position shown in FIG. 4, the print controller 202 moves the print head 8 vertically upward and moves the cap unit 10 vertically downward. The print controller 202 then moves the wiping unit 17 from the evacuation position to the right in FIG. 4. After that, the print controller 202 moves the print head 8 vertically downward to the maintenance position where maintenance operation can be performed.

On the other hand, in the case of moving the print head 8 from the printing position shown in FIG. 3 to the maintenance position shown in FIG. 4, the print controller 202 moves the print head 8 vertically upward while turning it by 45°. The print controller 202 then moves the wiping unit 17 from the evacuation position to the right. Following that, the print controller 202 moves the print head 8 vertically downward to the maintenance position where maintenance operation can be performed by the maintenance unit 16.

(Ink Supply Unit (Ink Circulation System))

Figure 5:
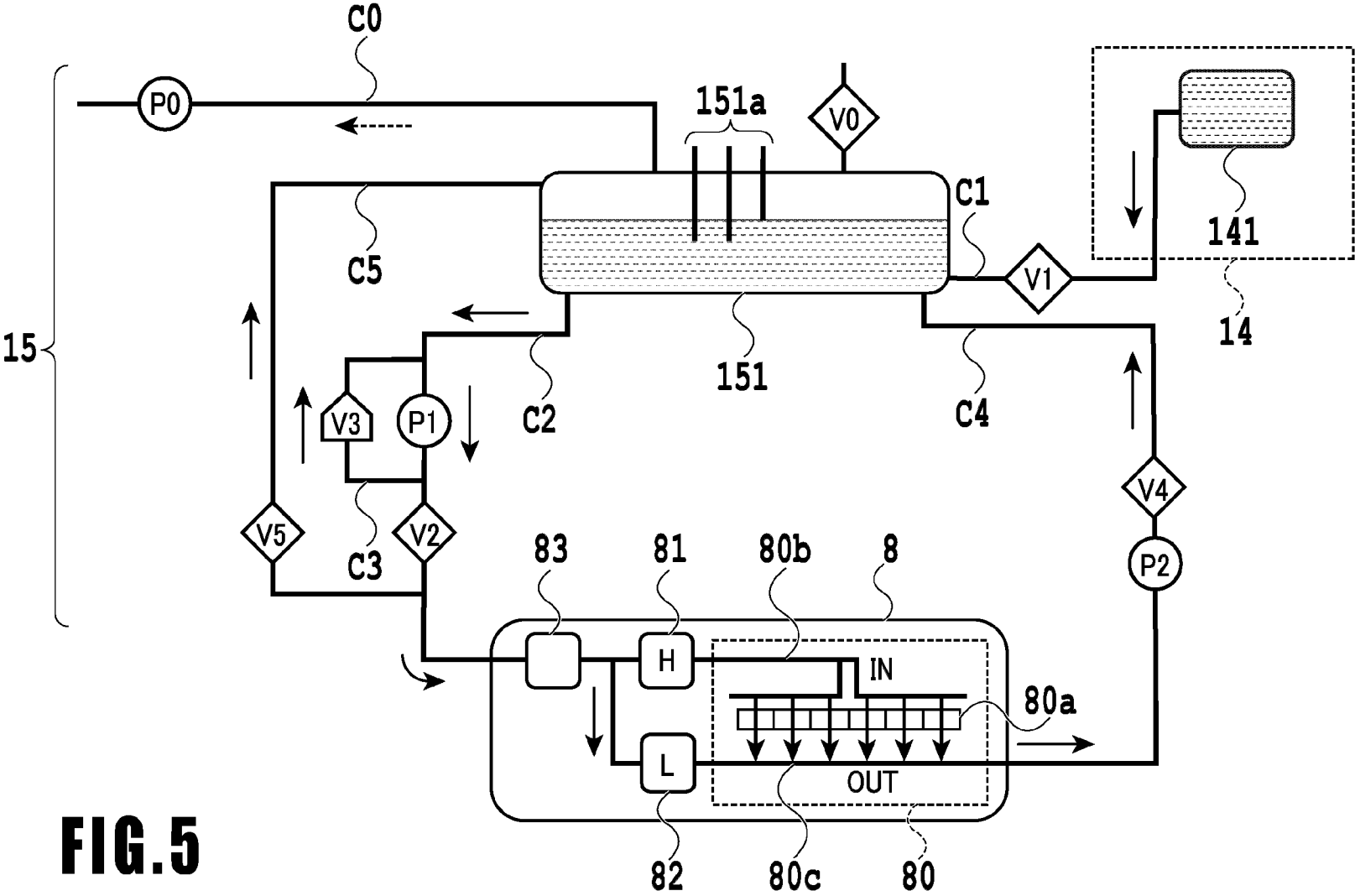
FIG. 5 is a diagram illustrating a flow path configuration of an ink circulation system.

FIG. 5 is a diagram including the ink supply unit 15 adopted in the printing apparatus 1 of the present embodiment. With reference of FIG. 5, a flow path configuration of an ink circulation system of the present embodiment will be described. The ink supply unit 15 is a configuration of supplying ink from the ink tank unit 14 to the print head 8 (also refereed as head unit in FIG. 5 and the subsequent Figs.). In the diagram, a configuration of one color ink is shown, but such a configuration is practically prepared for each color ink. The ink supply unit 15 is basically controlled by the ink supply control unit 209 shown in FIG. 2. Each configuration of the unit will be described below.

Ink is circulated mainly between a sub-tank 151 and the head unit 8. In the head unit 8, ink ejection operation is performed based on image data and ink that has not been ejected is collected and flows back to the sub-tank 151.

The sub-tank 151 in which a certain amount of ink is contained is connected to a supply flow path C2 for supplying ink to the head unit 8 and to a collection flow path C4 for collecting ink from the head unit 8. In other words, a circulation path for circulating ink is composed of the sub-tank 151, the supply flow path C2, the head unit 8, and the collection flow path C4. Further, the sub-tank 151 is connected to a flow path C0 in which air flows.

In the sub-tank 151, a liquid level detection unit 151*a* composed of a plurality of pins is provided. The ink supply control unit 209 detects presence/absence of a conducting current between those pins so as to grasp a height of an ink liquid level, that is, an amount of remaining ink inside the sub-tank 151. A vacuum pump P0 is a negative pressure generating source for reducing pressure inside the sub-tank 151. An atmosphere release valve V0 is a valve for switching between whether or not to make the inside of the sub-tank 151 communicate with atmosphere.

A main tank 141 is a tank that contains ink which is to be supplied to the sub-tank 151. The main tank 141 is made of a flexible member, and the volume change of the flexible member allows filling the sub-tank 151 with ink. The main tank 141 has a configuration removable from the printing apparatus body. In the midstream of a tank connection flow path C1 connecting the sub-tank 151 and the main tank 141, a tank supply valve V1 for switching connection between the sub-tank 151 and the main tank 141 is provided.

Under the above configuration, once the liquid level detection unit 151*a* detects that ink inside the sub-tank 151 is less than the certain amount, the ink supply control unit 209 closes the atmosphere release valve V0, a supply valve V2, a collection valve V4, and a head replacement valve V5 and opens the tank supply valve V1. In this state, the ink supply control unit 209 causes the vacuum pump P0 to operate. Then, the inside of the sub-tank 151 is to have a negative pressure and ink is supplied from the main tank 141 to the sub-tank 151. Once the liquid level detection unit 151*a* detects that the amount of ink inside the sub-tank 151 is more than the certain amount, the ink supply control unit 209 closes the tank supply valve V1 and stops the vacuum pump P0.

The supply flow path C2 is a flow path for supplying ink from the sub-tank 151 to the head unit 8, and a supply pump P1 and the supply valve V2 are arranged in the midstream of the supply flow path C2. During print operation, driving the supply pump P1 in the state of the supply valve V2 being open allows ink circulation in the circulation path while supplying ink to the head unit 8. The amount of ink to be ejected per unit time by the head unit 8 varies according to image data. A flow rate of the supply pump P1 is determined so as to be adaptable even in a case where the head unit 8 performs ejection operation in which ink consumption amount per unit time becomes maximum.

A relief flow path C3 is a flow path which is located in the upstream of the supply valve V2 and which connects the upstream and downstream of the supply pump P1. The connection point connected to the upstream of the supply pump P1 is referred to as a first connection point and the connection point connected to the downstream of the supply pump P1 is referred to as a second connection point. In the midstream of the relief flow path C3, a relief valve V3 which is a differential pressure valve is provided. In a case where an amount of ink supply from the supply pump P1 per unit time is larger than the total value of an ejection amount of the head unit 8 per unit time and a flow rate (ink drawing amount) in a collection pump P2 per unit time, the relief valve V3 is opened according to a pressure applied to its own. As a result, a cyclic flow path composed of a portion of the supply flow path C2 and the relief flow path C3 is formed. By providing the configuration of the above relief flow path C3, the amount of ink supply to the head unit 8 is adjusted according to the ink consumption amount by the head unit 8 so as to stabilize a pressure inside the circulation path irrespective of image data.

The collection flow path C4 is a flow path for collecting ink from the head unit 8, back to the sub-tank 151. Further, the collection pump P2 and the collection valve V4 are arranged in the midstream of the collection flow path C4. At the time of ink circulation within the circulation path, the collection pump P2 sucks ink from the head unit 8 by serving as a negative pressure generating source. By driving the collection pump P2, an appropriate differential pressure is generated between an IN flow path 80*b* and an OUT flow path 80*c* inside the head unit 8, thereby causing ink to circulate between the IN flow path 80*b* and the OUT flow path 80*c*. A flow path configuration inside the head unit 8 will be described later in detail.

The collection valve V4 is a valve for preventing a backflow at the time of not performing print operation, that is, at the time of not circulating ink within the circulation path. In the circulation path of the present embodiment, the sub-tank 151 is disposed higher than the head unit 8 in a vertical direction (see FIG. 1). For this reason, in a case where the supply pump P1 and the collection pump P2 are not driven, there may be a possibility that ink flows back from the sub-tank 151 to the head unit 8 due to a water head difference between the sub-tank 151 and the head unit 8. In order to prevent such a backflow, the present embodiment provides the collection valve V4 in the collection flow path C4.

Similarly, at the time of not performing print operation, that is, at the time of not circulating ink within the circulation path, the supply valve V2 also functions as a valve for preventing ink supply from the sub-tank 151 to the head unit 8.

A head replacement flow path C5 is a flow path connecting the supply flow path C2 and an air chamber (a space in which ink is not contained) of the sub-tank 151, and in its midstream, the head replacement valve V5 is provided. One end of the head replacement flow path C5 is connected to the upstream of the head unit 8 in the supply flow path C2, and the connection point is referred to as a third connection point. The third connection point is arranged in the downstream relative to the supply valve V2. The other end of the head replacement flow path C5 is connected to an upper part of the sub-tank 151 in the direction of gravity, so as to communicate with the air chamber inside the sub-tank 151. This connecting point is referred to as a fourth connection point. The head replacement flow path C5 is used in the case of pulling out ink from the head unit 8 in use such as upon replacing the head unit 8 or transporting the printing apparatus 1. The head replacement valve V5 is controlled by the ink supply control unit 209 so as to be closed except for a case of ink filling in the printing apparatus 1 and a case of pulling out ink from the head unit 8. In addition, the above-described supply valve V2 is provided, in the supply flow path C2, between a third connection point to the head replacement flow path C5 and a second connection point to the relief flow path C3. Noted that the second connection point may be arranged in the downstream of the supply flow path C2 relative to the third connection point.

Next, a flow path configuration inside the head unit 8 will be described. Ink supplied from the supply flow path C2 to the head unit 8 passes through a filter 83 and then is supplied to a first negative pressure control unit 81 and a second negative pressure control unit 82. The first negative pressure control unit 81 is set to have a control pressure of a low negative pressure. The second negative pressure control unit 82 is set to have a control pressure of a high negative pressure. Pressures in those first negative pressure control unit 81 and second negative pressure control unit 82 are generated within a proper range by the driving of the collection pump P2.

In an ink ejection unit 80, a printing element substrate 80*a* in which a plurality of ejection openings are arrayed is arranged in plural to form an elongate ejection opening array. A common supply flow path 80*b* (IN flow path) for guiding ink supplied from the first negative pressure control unit 81 and a common collection flow path 80*c* (OUT flow path) for guiding ink supplied from the second negative pressure control unit 82 also extend in an arranging direction of the printing element substrates 80*a*. Furthermore, in the individual printing element substrates 80*a*, individual supply flow paths connected to the common supply flow path 80*b* and individual collection flow paths connected to the common collection flow path 80*c* are formed. Accordingly, in each of the printing element substrates 80*a*, an ink flow is generated such that ink flows in from the common supply flow path 80*b* which has relatively lower negative pressure and flows out to the common collection flow path 80*c* which has relatively higher negative pressure. In the midstream of a path between the individual supply flow path and the individual collection flow path, a pressure chamber which is communicated with each ejection opening and which is filled with ink is provided. An ink flow is generated in the ejection opening and the pressure chamber even in a case where printing is not performed. Once the ejection operation is performed in the printing element substrate 80*a*, a part of ink moving from the common supply flow path 80*b* to the common collection flow path 80*c* is ejected from the ejection opening and is consumed. Meanwhile, ink not having been ejected moves toward the collection flow path C4 via the common collection flow path 80*c*.

Figure 6A:
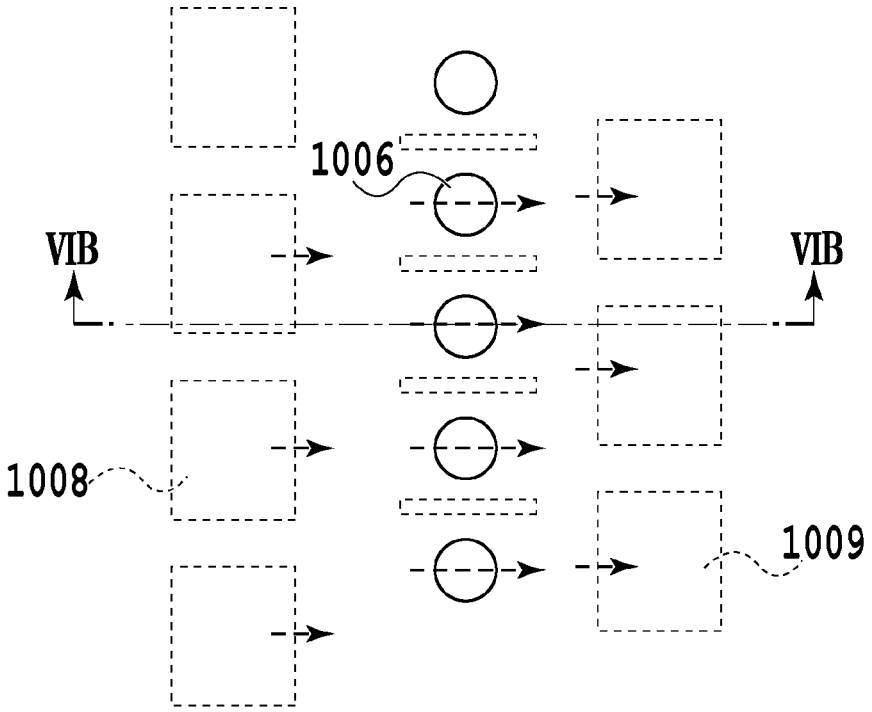
FIGS. 6A and 6B are diagrams illustrating an ejection opening and a pressure chamber.
Figure 6B:
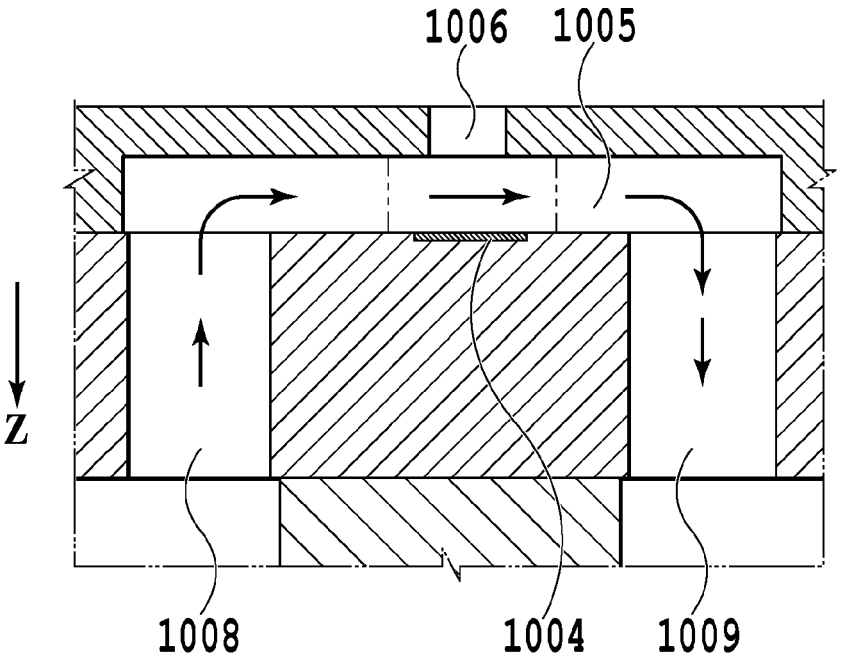

FIG. 6A is a plan schematic view enlarging a part of the printing element substrate 80*a*, and FIG. 6B is a sectional schematic view of a cross section taken from line VIB-VIB of FIG. 6A. In the printing element substrate 80*a*, a pressure chamber 1005 which is filled with ink and an ejection opening 1006 from which ink is ejected are provided. In the pressure chamber 1005, a printing element 1004 is provided at a position facing the ejection opening 1006. Further, in the printing element substrate 80*a*, a plurality of ejection openings 1006 are formed, each of which is connected to an individual supply flow path 1008 which is connected to the common supply flow path 80*b* and an individual collection flow path 1009 which is connected to the common collection flow path 80*c*.

According to the above configuration, in the printing element substrate 80*a*, an ink flow is generated such that ink flows in from the common supply flow path 80*b* which has relatively lower negative pressure (high pressure) and flows out to the common collection flow path 80*c* which has relatively higher negative pressure (low pressure). To be more specific, ink flows in the order of the common supply flow path 80*b*, the individual supply flow path 1008, the pressure chamber 1005, the individual collection flow path 1009, and the common collection flow path 80*c*. Once ink is ejected by the printing element 1004, part of ink moving from the common supply flow path 80*b* to the common collection flow path 80*c* is ejected from the ejection opening 1006 to be discharged outside the head unit 8. Meanwhile, ink not having been ejected from the ejection opening 1006 is collected and flows into the collection flow path C4 via the common collection flow path 80*c*.

Figure 7A:
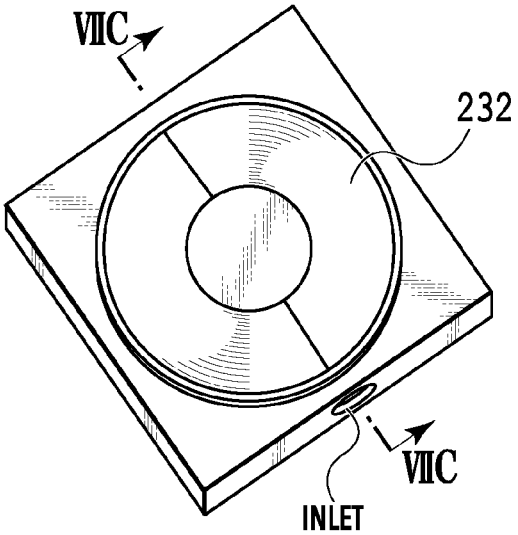
FIGS. 7A to 7C are diagrams illustrating a negative pressure control unit.
Figure 7B:
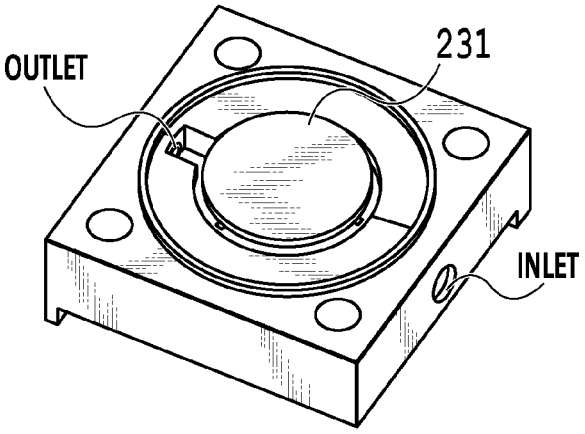
Figure 7C:
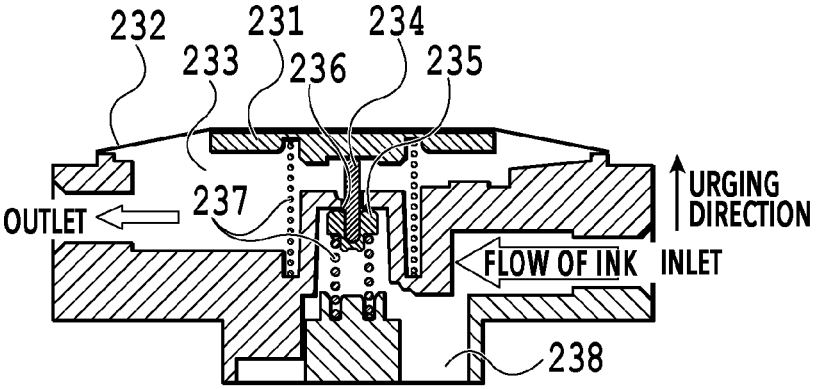

FIG. 7A to FIG. 7C show the first negative pressure control unit 81 provided in the head unit 8. FIG. 7A and FIG. 7B are appearance perspective views, and in particular, FIG. 7B shows inside the first negative pressure control unit 81 in the state where a flexible film 232 is not shown. FIG. 7C is a cross section taken from line VIIC-VIIC of FIG. 7A. The first negative pressure control unit 81 and the second negative pressure control unit 82 are differential pressure valves and have the same structure other than a difference in control pressures (the initial load of a spring), and therefore, a description on the second negative pressure control unit 82 will be omitted.

The first negative pressure control unit 81 is composed of the pressure receiving plate 231 shown in FIG. 7B and the flexible film 232 sealing an ambient air space so as to form a first pressure chamber 233 inside the first negative pressure control unit 81. The flexible film 232 is welded on an edge of a circular shape and on the pressure receiving plate 231 as shown in FIG. 7B. In accordance with the increase/decrease of ink inside the first pressure chamber 233, the flexible film 232 and the pressure receiving plate 231 on which the flexible film 232 is welded are displaced vertically.

In the upstream of the first pressure chamber 233 in an ink supplying direction, a second pressure chamber 238 connected to the supply pump P1, a shaft 234 coupled to the pressure receiving plate 231, a valve 235 coupled to the shaft 234, and an orifice 236 which abuts the valve 235 are provided. The orifice 236 of the present embodiment is provided at a boundary between the first pressure chamber 233 and the second pressure chamber 238. The valve 235, the shaft 234, and the pressure receiving plate 231 are further urged in the vertically upward direction by using an urging member (spring) 237.

In a case where an absolute value of a pressure inside the first pressure chamber 233 is equal to or more than a first threshold value (a case where a negative pressure is lower than the first threshold value), the valve 235 abuts the orifice 236 as a result of an urging force of the urging member 237 to interrupt the connection between the first pressure chamber 233 and the second pressure chamber 238. On the other hand, in a case where an absolute value of a pressure inside the first pressure chamber 233 is less than the first threshold value, that is, a negative pressure higher than the first threshold value is applied to the first pressure chamber 233, the flexible film 232 is contracted to be displaced downward. Accordingly, the pressure receiving plate 231 and the valve 235 are displaced downward against the urging force of the urging member 237, and the valve 235 and the orifice 236 are separated so that the first pressure chamber 233 and the second pressure chamber 238 are connected to each other. As a result of this connection, ink supplied by the supply pump P1 flows toward the first pressure chamber 233.

The first negative pressure control unit 81 has the configuration of the above-described differential pressure valve, and thus controls an inflow pressure and an outflow pressure to be constant. The second negative pressure control unit 82 uses the urging member 237 having a larger urging force than that of the first negative pressure control unit 81 so as to generate a higher negative pressure than that in the first negative pressure control unit 81. In other words, in the second negative pressure control unit 82, the valve is opened in a case where an absolute value of the pressure of the unit becomes less than a second threshold value, which is smaller than the first threshold value. Therefore, once the driving of the collection pump P2 starts, the first negative pressure control unit 81 is firstly opened and then the second negative pressure control unit 82 is opened.

Under the above configuration, in performing print operation, the ink supply control unit 209 closes the tank supply valve V1 and the head replacement valve V5 and opens the atmosphere release valve V0, the supply valve V2, and the collection valve V4 to drive the supply pump P1 and the collection pump P2. As a result, the circulation path in the order of the sub-tank 151, the supply flow path C2, the head unit 8, the collection flow path C4, and the sub-tank 151 is established. In a case where an amount of ink supply from the supply pump P1 per unit time is larger than the total value of an ejecting amount of the head unit 8 per unit time and a flow rate in the collection pump P2 per unit time, ink flows from the supply flow path C2 into the relief flow path C3. As a result, the flow rate of ink from the supply flow path C2 to the head unit 8 is adjusted.

In the case of not performing print operation, the ink supply control unit 209 stops the supply pump P1 and the collection pump P2 and closes the atmosphere release valve V0, the supply valve V2, and the collection valve V4. As a result, the ink flow inside the head unit 8 stops and the backflow caused by the water head difference between the sub-tank 151 and the head unit 8 is suppressed. Further, by closing the atmosphere release valve V0, ink leakage and ink evaporation from the sub-tank 151 are suppressed.

(Ink Filling)

Next, an explanation is given of ink filling in the ink circulation system explained with reference to FIG. 5. Ink filling is performed, for example, after the main tank 141 is attached to the ink tank unit 14, so as to fill in the sub-tank 151, the head unit 8, and the flow path, through which ink circulates, with ink. Note that the filling operation is performed not only at the time of arrival of the printing apparatus 1, but also after replacement of the head unit 8 or after collection of entire ink in the head unit 8 into the sub-tank 151 for the purpose of transportation.

Figure 8:
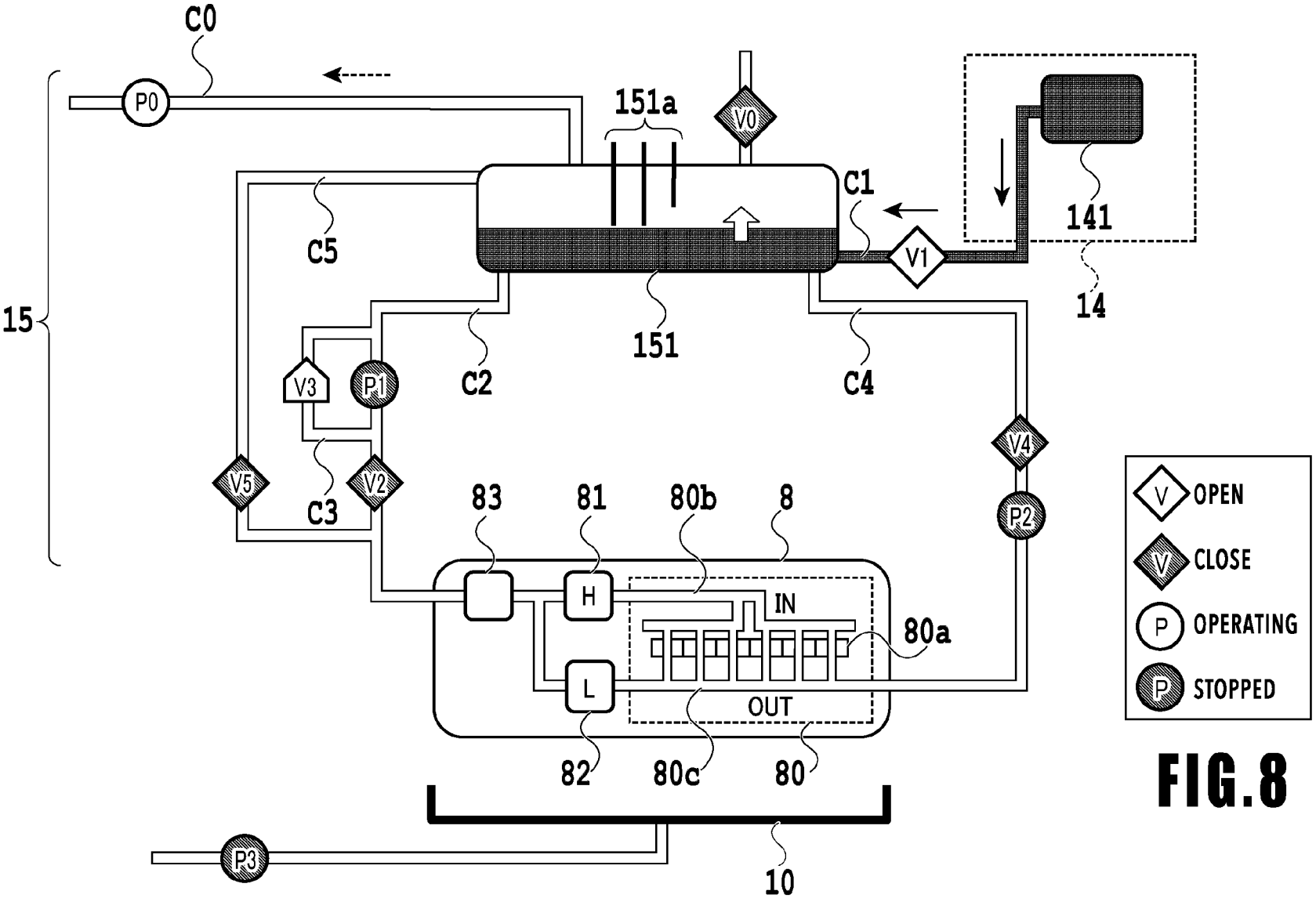
FIG. 8 is a diagram showing a state of the ink circulation system.

FIG. 8 shows a state of the ink circulation system in which the sub-tank 151 is refilled with ink from the main tank 141. Here, the atmosphere release valve V0, the supply valve V2, the head replacement valve V5, and the collection valve V4 are closed (CLOSE), and the tank supply valve V1 is open (OPEN). Further, the supply pump P1 and the collection pump P2 are stopped. In a case where the vacuum pump P0 is driven in this state, a negative pressure is generated in the sub-tank 151, and the sub-tank 151 is refilled with ink from the main tank 141 via the tank connection flow path C1. In a case where the liquid level detection unit 151*a* detects that the amount of ink inside the sub-tank 151 is more than a predetermined amount, the ink supply control unit 209 closes the tank supply valve V1 and stops the vacuum pump P0. Then, the ink supply control unit 209 opens the atmosphere release valve V0 and releases the pressure in the sub-tank 151, which is a negative pressure, to the atmosphere.

Next, the ink supply control unit 209 supplies ink from the sub-tank 151 and fills in the upstream flow path with ink. The upstream flow path is a general term for flow paths between the sub-tank 151 and the head unit 8 and includes a supply flow path C2, a relief flow path C3, and a head replacement flow path C5.

Figure 9:
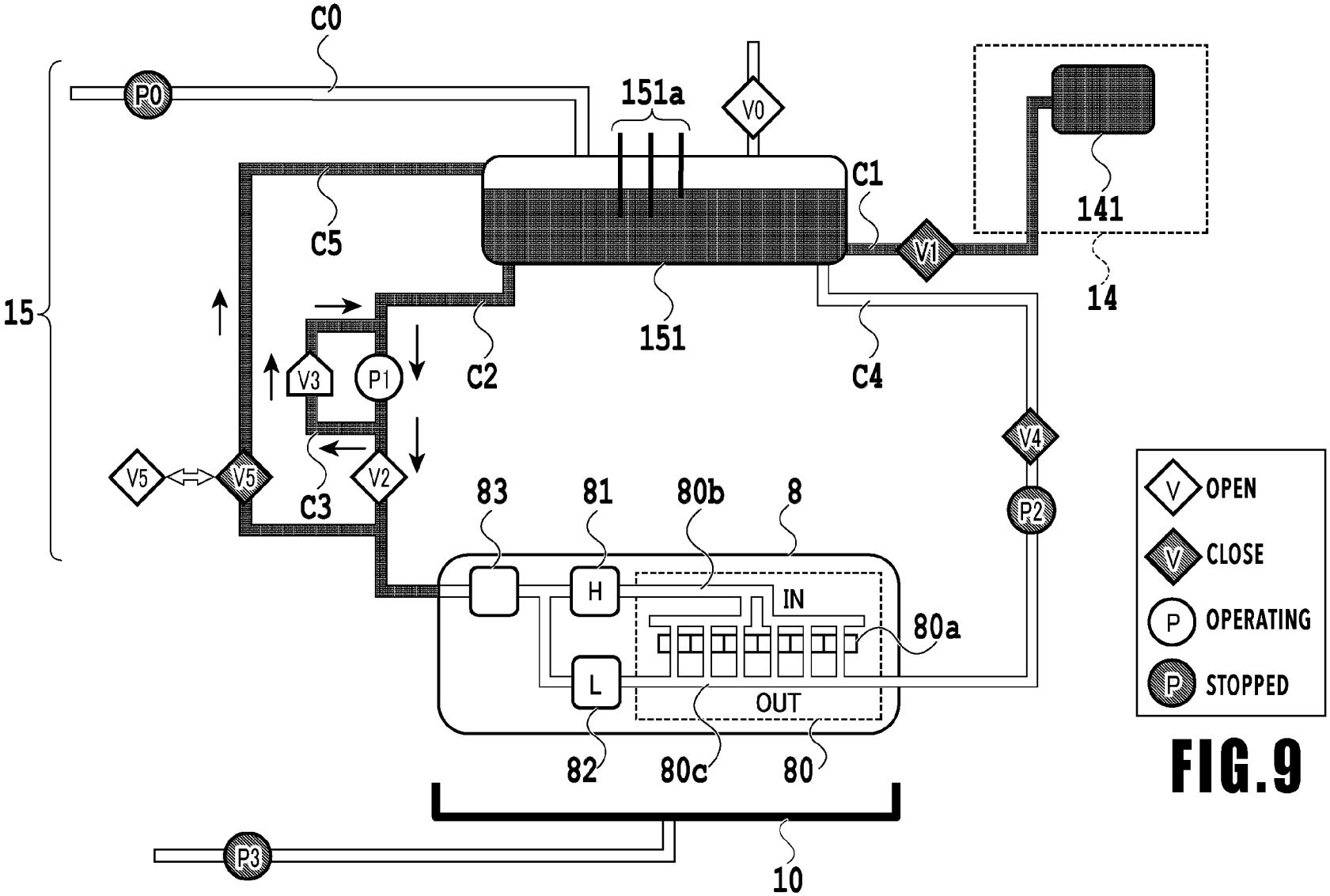
FIG. 9 is a diagram showing a state of the ink circulation system.

FIG. 9 shows a state of the ink circulation system in which ink filling in the upstream flow path is performed. Here, the supply valve V2 and the head replacement valve V5 are open after refill of ink to the sub-tank 151 is completed. When the supply pump P1 is driven in this state, ink is supplied from the sub-tank 151, and the upstream flow path is filled in with ink. Note that the first negative pressure control unit 81 and the second negative pressure control unit 82 are closed since the collection pump P2 is stopped and a predetermined negative pressure is not applied to the first negative pressure control unit 81 and the second negative pressure control unit 82. Therefore, ink is not supplied to the head unit 8. After ink filling in the upstream flow path is completed, the ink supply control unit 209 fills in the head unit 8 with ink.

The ink supply control unit 209 drives the supply pump P1 to supply ink up to the supply flow path C2, which is in the upstream of the head unit 8. Next, the ink supply control unit 209 caps the head unit 8 with the cap unit 10. That is, the ejection opening surface 8*a* of the head unit 8 is covered with the cap member 10*a* of the cap unit 10. Next, the ink supply control unit 209 drives the vacuum pump P3 of the cap unit 10. That is, a negative pressure is generated in the cap unit 10 while ink is fed by the supply pump P1. Due to the negative pressure, the negative pressure control unit in the head unit 8 is released and ink is drawn to the ejection opening, so that ink filling is performed. The ink supply control unit 209 stops the supply pump P1 and the vacuum pump P3 after a lapse of a predetermined period of time. After ink filling in the head unit 8 is completed, the ink supply control unit 209 fills in the collection flow path C4 with ink.

Figure 10:
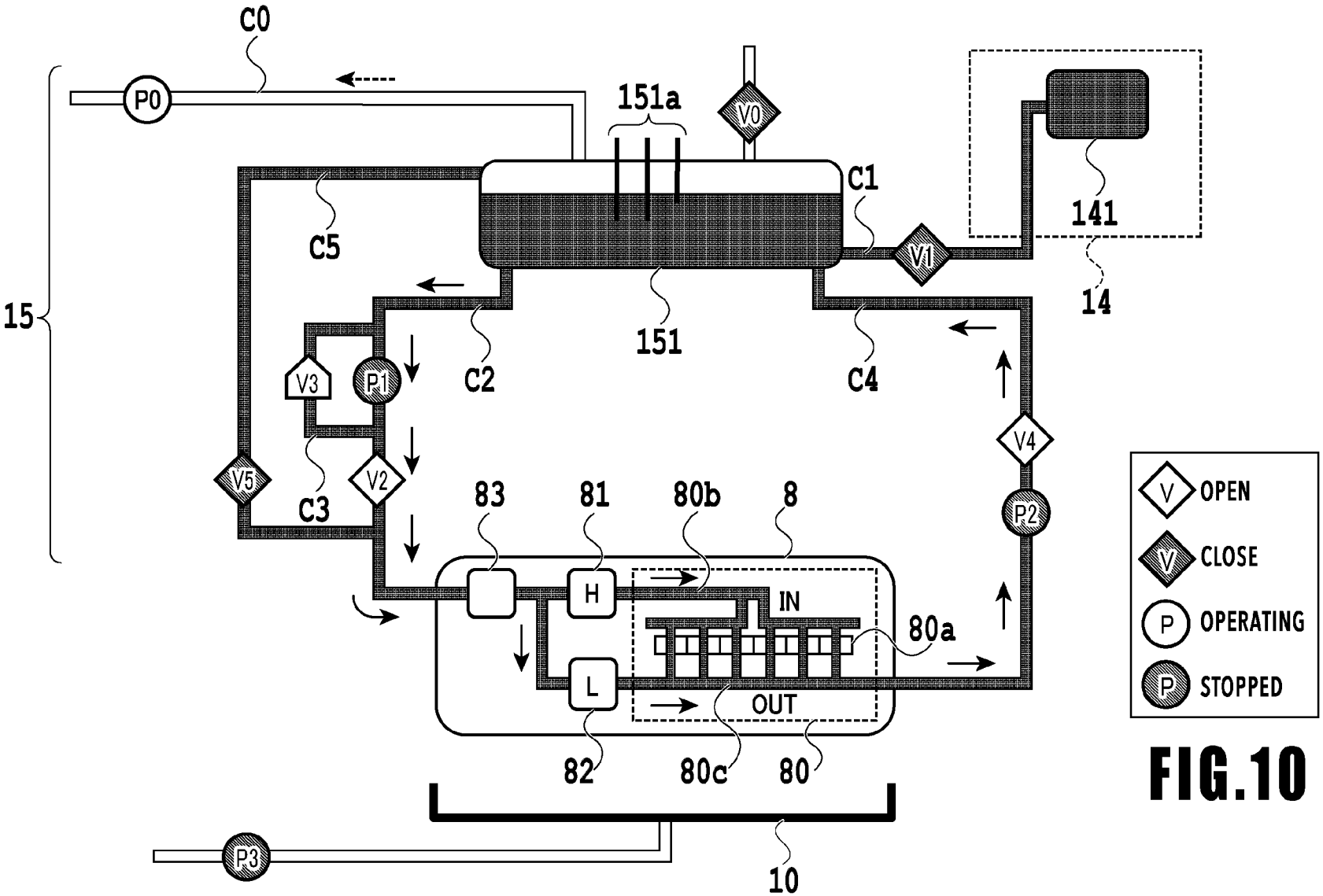
FIG. 10 is a diagram showing a state of the ink circulation system.

FIG. 10 shows a state of the ink circulation system in which the collection flow path C4 is filled in with ink. Here, after ink filling in the head unit 8 is completed, the vacuum pump P0 for the sub-tank 151 is driven while the collection valve V4 is opened and the atmosphere release valve V0 is closed. The ink supply control unit 209 drives the vacuum pump P0 for the sub-tank 151 while the collection valve V4 is opened and the atmosphere release valve V0 is closed. Due to the negative pressure in the sub-tank 151 generated by driving of the vacuum pump P0, the ink flows from the head unit 8 to the collection flow path C4. After ink filling in the collection flow path C4 is completed, the ink supply control unit 209 stops the vacuum pump P0.

(Ink Pullout Process)

Figure 11:
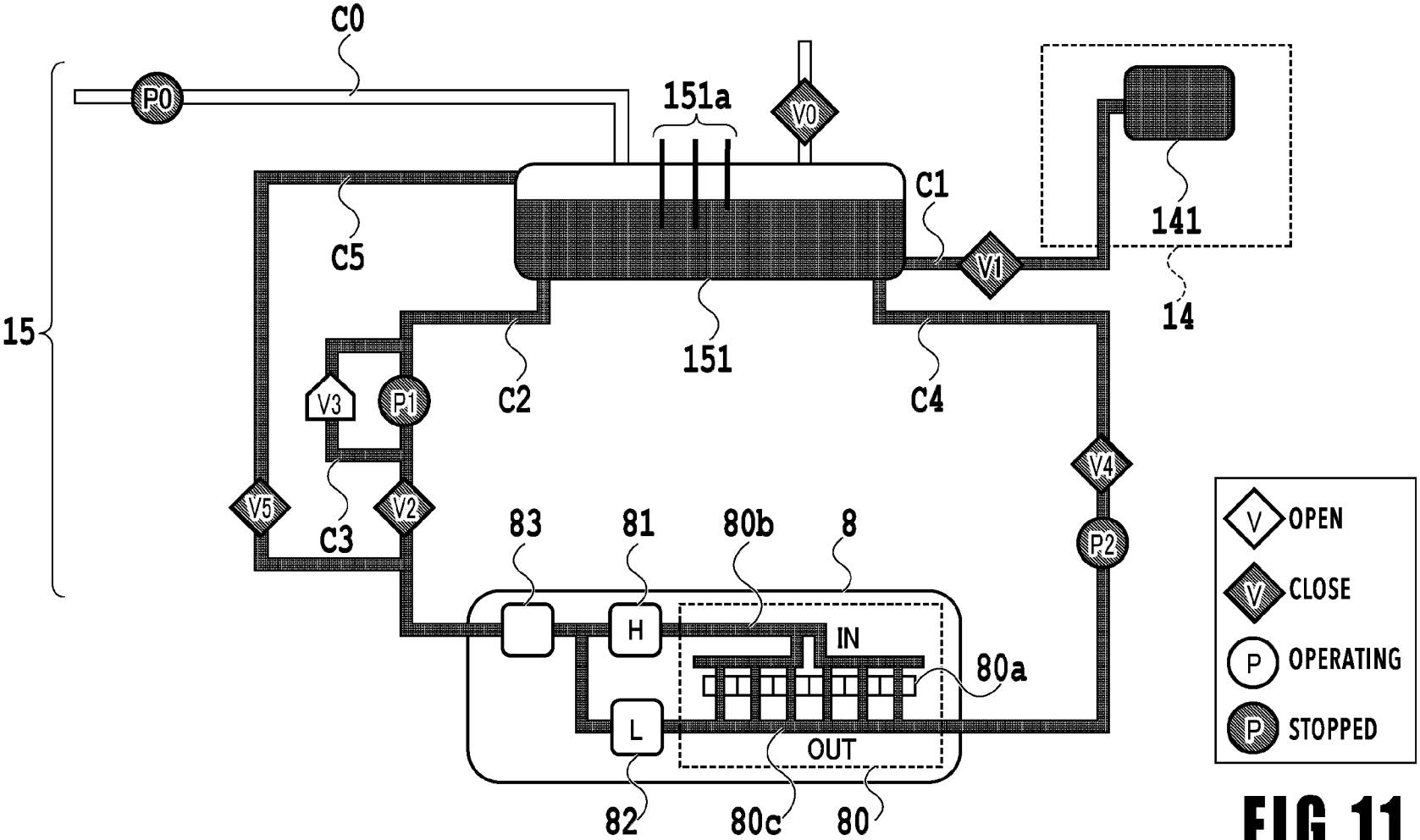
FIG. 11 is a diagram showing a state of the ink circulation system.

FIG. 11 is a diagram showing a state of the ink circulation system in which flow paths and the head unit 8 are filled in with ink due to the ink filling process as described above. Hereinafter, an explanation is given of a process of pulling out the ink filled in as described above from the flow paths and the head unit 8 into the sub-tank 151. For example, in a case where the head unit 8 is broken and replaced, the head unit 8 is separated from the ink supply unit 15. Here, in a case where ink in the head unit 8 is not sufficiently pulled out, the ink remaining in the head unit 8 is discarded as waste ink. In addition, ink leakage occurs when the head unit 8 is separated from the ink supply unit 15. Therefore, it is desired to properly pull out filled-in ink from the flow paths and the head unit 8. In the present embodiment, a process for pulling out ink in the head unit 8 from each of the upstream flow path side and the collection flow path C4 side is performed.

Figure 12:
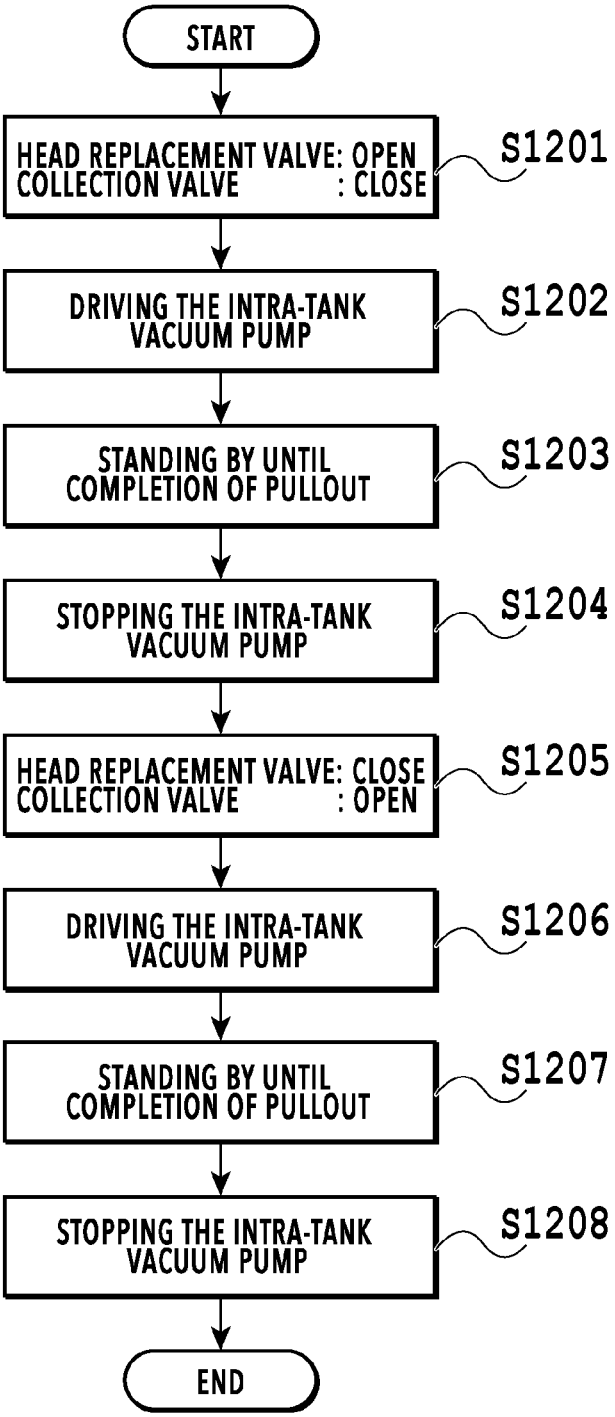
FIG. 12 is a diagram showing an example of a flowchart.

FIG. 12 is a diagram showing an example of a flow chart of an ink pullout process in the present embodiment. The ink pullout process is executed by the ink supply control unit 209 controlling operation of various pumps and various valves provided in the ink supply unit 15. The ink supply control unit 209 controls driving and stopping of various pumps including the vacuum pump P0 (i.e., intra-tank vacuum pump) that reduces pressure inside the sub-tank 151. Further, the ink supply control unit 209 controls various valves including the head replacement valve V5 (i.e., replacement drive valve) and the collection valve V4 such that the various valves can be opened or closed. The state of the ink circulation system before the process of FIG. 12 is initiated is as shown in FIG. 11. That is, the atmosphere release valve V0, the tank supply valve V1, the supply valve V2, the collection valve V4, and the head replacement valve V5 are closed (CLOSE). Further, the vacuum pump P0, the supply pump P1, and the collection pump P2 are stopped.

First, at Step S1201, the ink supply control unit 209 opens the head replacement valve V5 (OPEN). On the other hand, the ink supply control unit 209 keeps the collection valve V4 (i.e., collection drive valve) in a closed state (CLOSE). Then, at Step S1202, the ink supply control unit 209 drives the vacuum pump P0 (i.e., intra-tank vacuum pump) to generate a negative pressure in the sub-tank 151. As a result, pulling out of ink on the upstream flow path side is initiated.

Figure 13:
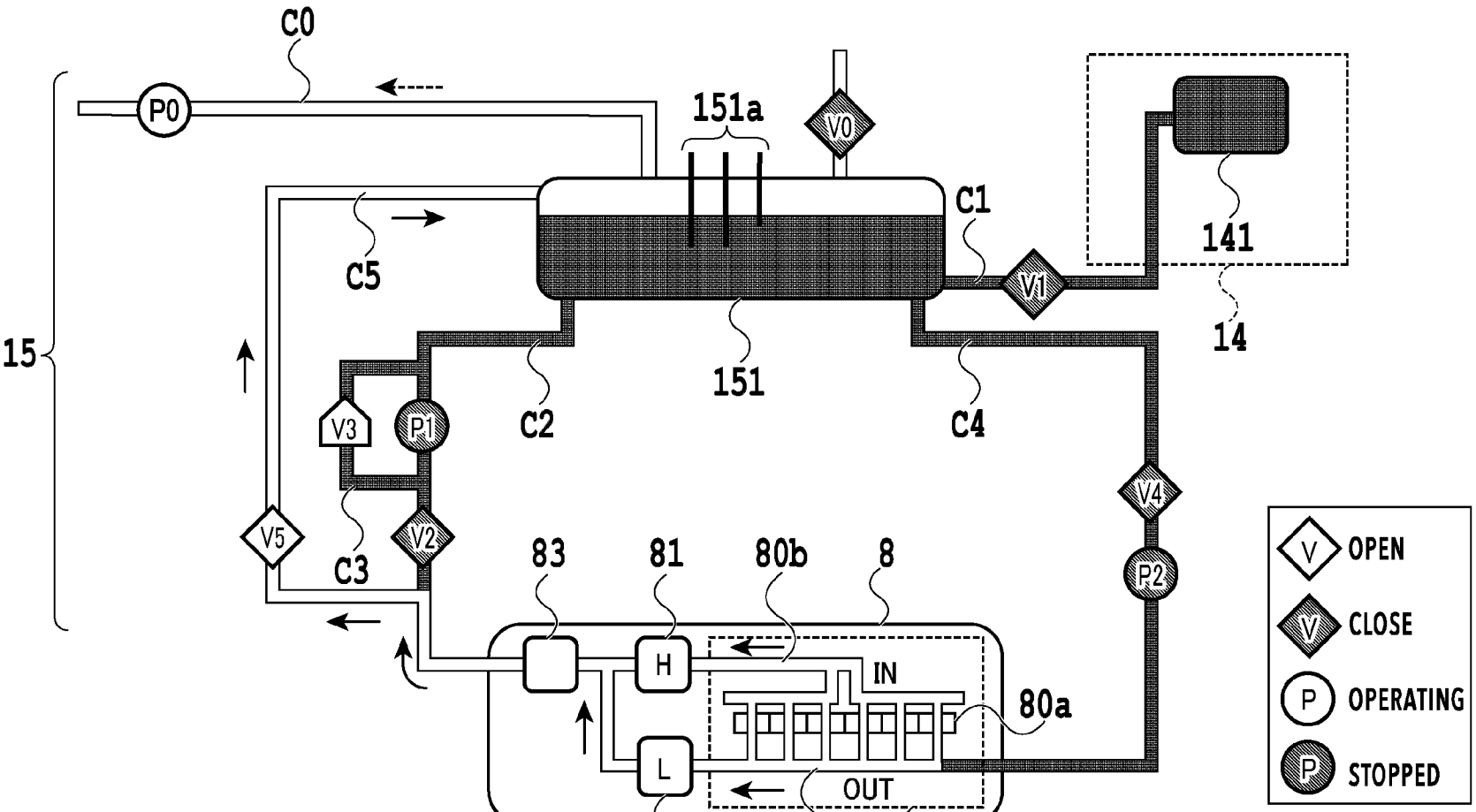
FIG. 13 is a diagram showing a state of the ink circulation system.

FIG. 13 is a diagram showing a state of the ink circulation system in which ink on the upstream flow path side is being pulled out. Since the head replacement valve V5 is opened (OPEN), the ink in the head replacement flow path C5 and a part of the supply flow path C2 is pulled out into the sub-tank 151 due to a negative pressure generated in the sub-tank 151 by driving of the vacuum pump P0. In addition, most of the ink filled in the head unit 8 is pulled out into the sub-tank 151 via the head replacement flow path C5. As a specific phenomenon, firstly, the negative pressure generated by the vacuum pump P0 breaks a meniscus formed on the ejection opening surface 8*a* of the head unit 8. Then, the atmosphere flows in from the ejection opening surface 8*a* where the meniscus is broken, so that ink filled in the head unit 8 is pulled out into the sub-tank 151 via the head replacement flow path C5 together with the atmosphere that has flown in. Since ink is pulled out from the ejection opening surface 8*a* as described above, ink partially remains in the flow path of the head unit 8 on the collection flow path C4 side, which is in the downstream relative to the ejection opening surface 8*a*, as illustrated in FIG. 13. Furthermore, since the ink is pulled out from the ejection opening surface 8*a* via the head replacement flow path C5, ink partially remains in the supply flow path C2 on the upstream side relative to the third connection point, which is the connection point of the head replacement flow path C5 and the supply flow path C2.

At Step S1203, the ink supply control unit 209 stands by for a predetermined period of time until pulling out of ink is completed. Then, at Step S1204, the ink supply control unit 209 stops the vacuum pump P0. Through the above processing, pulling out of ink from a major part of the head unit 8 and a part of the upstream flow path side is completed.

Subsequently, at Step S1205, the ink supply control unit 209 closes the head replacement valve V5 (CLOSE). On the other hand, the ink supply control unit 209 opens the collection valve V4 (OPEN). Then, at Step S1206, the ink supply control unit 209 drives the vacuum pump P0 (i.e., intra-tank vacuum pump) to generate a negative pressure in the sub-tank 151. As a result, pulling out of ink on the collection flow path C4 side (i.e., downstream flow path side) is initiated.

Figure 14:
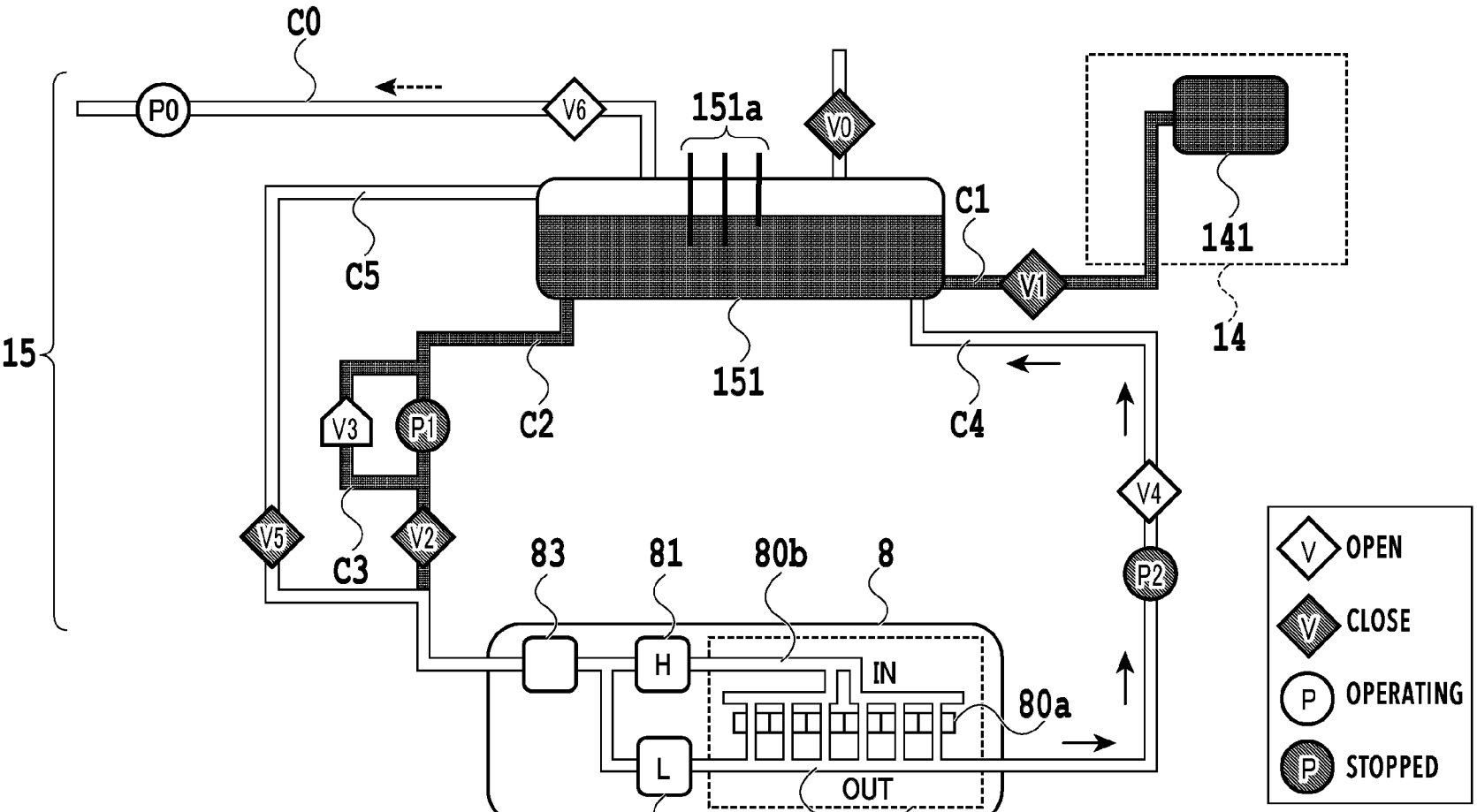
FIG. 14 is a diagram showing a state of the ink circulation system.

FIG. 14 is a diagram showing a state of the ink circulation system in which ink on the collection flow path C4 side is being pulled out. The head replacement valve V5 is closed (CLOSE), and the collection valve V4 is opened (OPEN). Then, due to the negative pressure generated in the sub-tank 151 by driving of the vacuum pump P0, the ink in the collection flow path C4 and the part of the ink remaining in the head unit 8 are pulled out into the sub-tank 151. In the pullout process on the upstream flow path side as described above, the meniscus of the ejection opening surface 8*a* of the head unit 8 has already been broken. The atmosphere flows in from the ejection opening surface 8*a* where meniscus is broken, so that ink filled in the head unit 8 is pulled out into the sub-tank 151 via the collection flow path C4 together with the atmosphere that has flown in. As described above, ink filled in the head unit 8 can be properly pulled out since the process of pulling ink out is performed from each of the supply flow path C2 side (i.e., upstream flow path side) and the collection flow path C4 side.

At Step S1207, the ink supply control unit 209 stands by for a predetermined period of time until pulling out of ink is completed. Then, at Step S1208, the ink supply control unit 209 stops the vacuum pump P0. Through the processing from Step S1205 to Step S1208, pulling out of the part of the ink remaining in the head unit 8 and the ink in the collection flow path C4 is completed.

Note that, regarding pulling out of ink from the collection flow path C4, an explanation has been given of a mode in which ink on the collection flow path C4 side is pulled out by use of the vacuum pump P0 for generating a negative pressure in the sub-tank 151. According to such a configuration, even in a case where the collection pump P2 is a pump having low output power or in a case where flow resistance is large because a flow path is long or narrow, etc., ink can be properly pulled out. However, it is not necessary that the collection pump P2 is kept in a stopped state at the time of pulling ink out, and there may be a mode in which the collection pump P2 is driven at the time of pulling ink out from the collection flow path C4. That is, at Step S1206, the vacuum pump P0 and the collection pump P2 may be driven. By driving the collection pump P2, the collection pump P2 can play an auxiliary role in the pulling out of ink. In other words, pulling out of ink can be completed more quickly since the negative pressure acting on the head unit 8 can be increased as compared with the case where the vacuum pump P0 is solely driven.

Furthermore, in the processing of the flowchart shown in FIG. 12, an explanation has been given with an example of the mode in which ink is pulled out from the upstream flow path side and then pulled out from the collection flow path C4 side. However, the present invention is not limited to the example. There may be a mode in which ink is pulled out firstly from the collection flow path C4 side and then from the upstream flow path side. That is, Steps S1205 to S1208 may be moved to before Step S1201. Regardless of which mode is adopted, ink in the head unit 8 can be properly pulled out since the process of pulling ink out is performed from each of the supply flow path C2 side (i.e., upstream flow path side) and the collection flow path C4 side.

Furthermore, in the processing of the flowchart shown in FIG. 12, an explanation has been given of a mode in which the vacuum pump P0 is driven after the control of the valves. However, the present invention is not limited to the mode. There may be a mode in which the vacuum pump P0 is driven firstly so that a predetermined negative pressure is generated and then the control of the valves is performed. In the case where the vacuum pump P0 is driven firstly so that a predetermined negative pressure is generated and then the valves are opened, a negative pressure may not be generated in the flow paths beyond necessity. Therefore, it is possible to prevent ink of a different color from being absorbed in an ejection opening and reduce occurrence of mixture of ink colors. Details are described below with reference to FIG. 22.

Further, in the present embodiment, an explanation has been given of a mode in which the head replacement flow path C5 is provided in addition to the supply flow path C2 so that pulling out of ink on the upstream flow path side is performed through the head replacement flow path C5. However, the present invention is not limited to the example. The supply valve V2 may be controlled instead of the head replacement valve V5 so as to pull out ink on the upstream flow path side. Alternatively, both of the head replacement valve V5 and the supply valve V2 may be controlled so as to pull out ink on the upstream flow path side. Each of the head replacement valve V5 and the supply valve V2 may be referred to as a supply drive valve. Note that, in an ink circulation system in which the head replacement flow path C5 is not provided, a supply drive valve corresponding to the supply valve V2 may be controlled.

Second Embodiment

In the present embodiment, an explanation is given of a mode in which, in a case where there is a connection unit (hereinafter referred to as a "joint") between the head unit 8 and the ink supply unit 15 to connect the respective units, the head unit 8 is separated from the ink supply unit 15. In a case of replacing the head unit 8, the joint is released, and the head unit 8 and the ink supply unit 15 are separated from each other. In a case where the joint is released, ink may drip from the connection surface of the joint. In the present embodiment, an explanation is given of a mode for preventing ink from dripping at the time of releasing the joint as described above. Noted that explanations of the configurations similar to those explained in the first embodiment are omitted.

Figure 15:
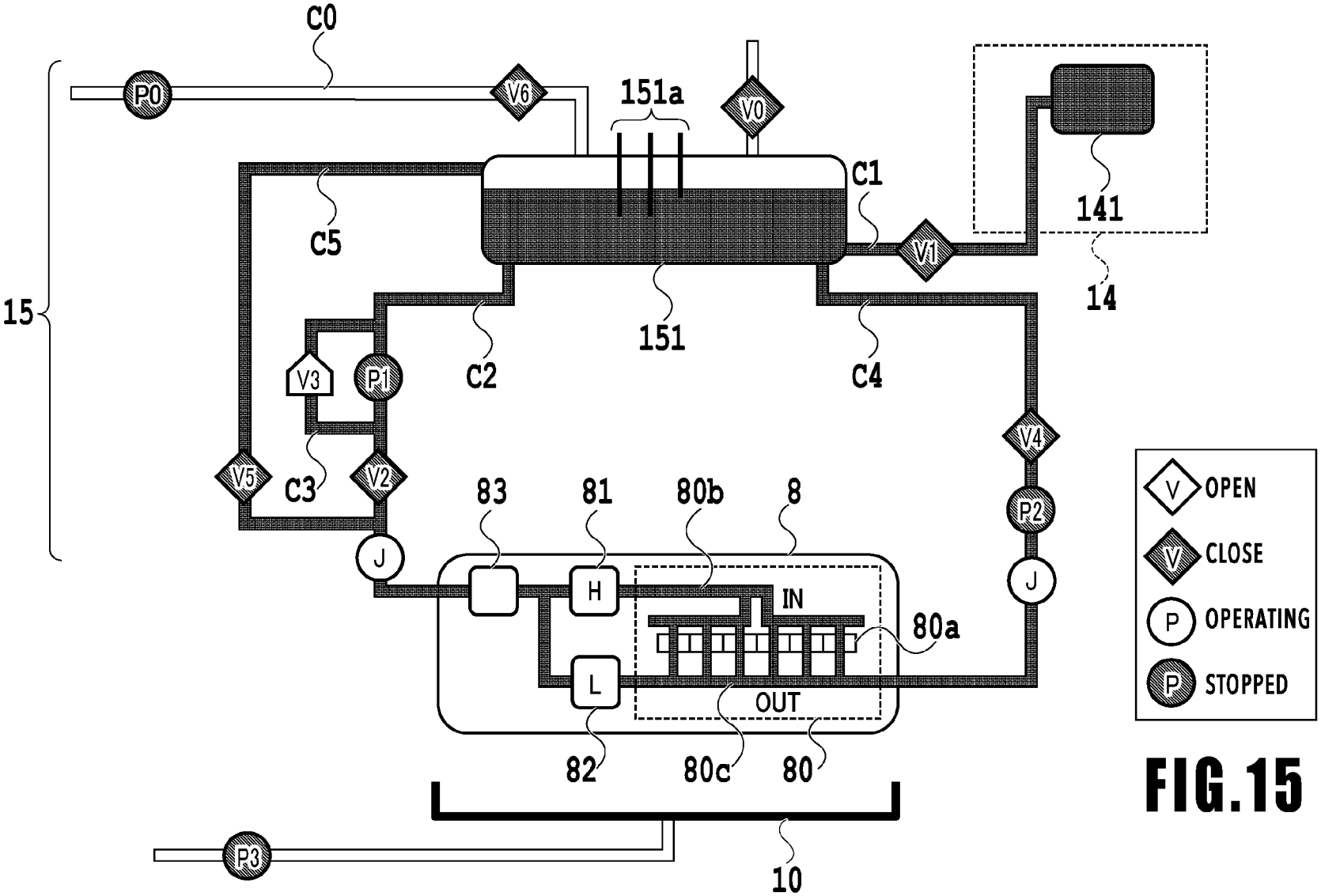
FIG. 15 is a diagram showing a state of the ink circulation system.

FIG. 15 is a diagram showing a state of the ink circulation system filled in with ink in the present embodiment. The joint J on the supply flow path C2 side is disposed on the downstream side (i.e., the head unit 8 side) of the supply flow path C2 relative to the third connection point, which is the connection point of the head replacement flow path C5 and the supply flow path C2. The joint J on the collection flow path C4 side is disposed on the upstream side (i.e., the head unit 8 side) of the collection flow path C4 relative to the collection pump P2.

Figure 16:
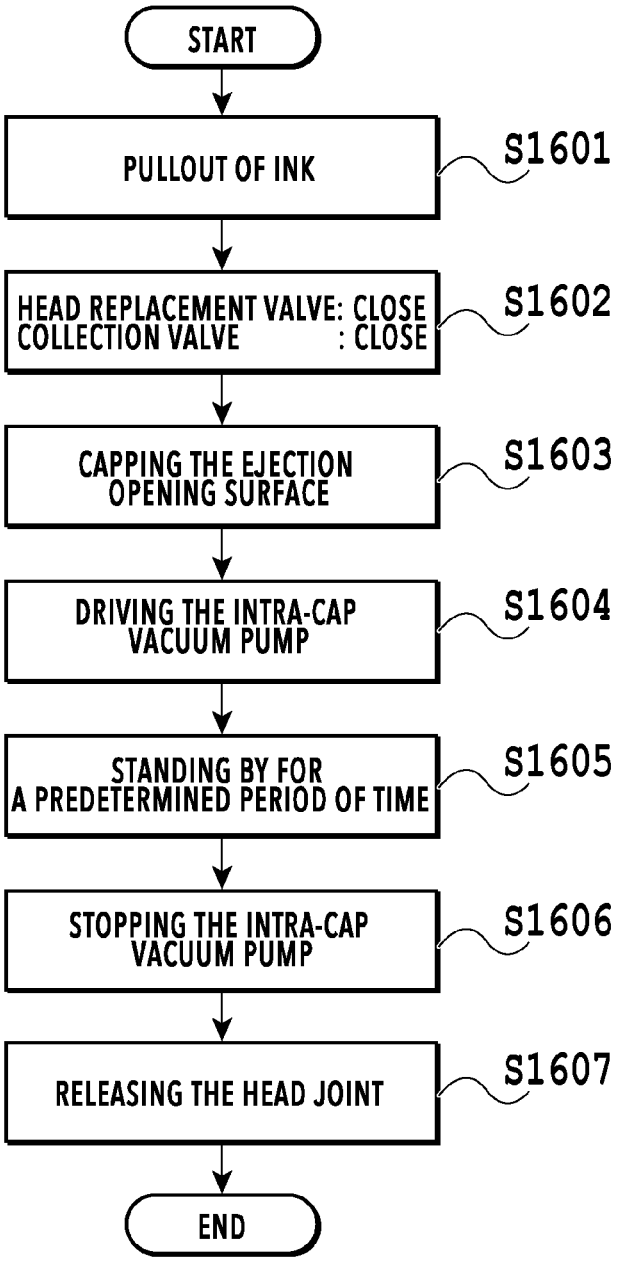
FIG. 16 is a diagram showing an example of a flowchart.

FIG. 16 is a diagram showing an example of a flow chart of an ink pullout process in the present embodiment. The ink pullout process is executed by the ink supply control unit 209 controlling operation of various pumps and various valves provided in the ink supply unit 15. The state of the ink circulation system before the processing of FIG. 16 is initiated is as shown in FIG. 15. That is, the atmosphere release valve V0, the tank supply valve V1, the supply valve V2, the collection valve V4, and the head replacement valve V5 are closed (CLOSE). Further, the vacuum pump P0, the supply pump P1, and the collection pump P2 are stopped.

Firstly, at Step S1601, the ink supply control unit 209 performs the ink pullout process explained in the first embodiment. That is, the process of pulling out ink in the head unit 8, on the upstream flow path side, and on the collection flow path C4 side is performed. Through the processing of Step S1601, most of the ink in the flow paths is pulled out. However, ink remaining in the flow paths is also expected. In a case where such remaining ink exists, ink leakage may occur from the connection surface of the joint J if the joint J is released. Therefore, in the present embodiment, the joint J is controlled to have a negative pressure in a case where the connection of the joint J is released. If a negative pressure is generated in the joint J, when the connection of the joint J is released, the ink existing on the connection surface is absorbed into flow paths due to the negative pressure. Therefore, it is possible to prevent ink leakage from occurring in a case where the connection of the joint J is released.

At Step S1602, the ink supply control unit 209 closes the head replacement valve V5 and the collection valve V4 (CLOSE). At Step S1603, the ink supply control unit 209 caps the head unit 8 with the cap unit 10. That is, the ejection opening surface 8*a* of the head unit 8 is capped. Subsequently, at Step S1604, the ink supply control unit 209 drives the vacuum pump P3 (i.e., intra-cap vacuum pump) to generate a negative pressure in the cap unit 10. At Step S1605, the ink supply control unit 209 stands by for a predetermined period of time until a sufficient negative pressure is generated. At Step S1606, the ink supply control unit 209 stops the vacuum pump P3.

Figure 17:
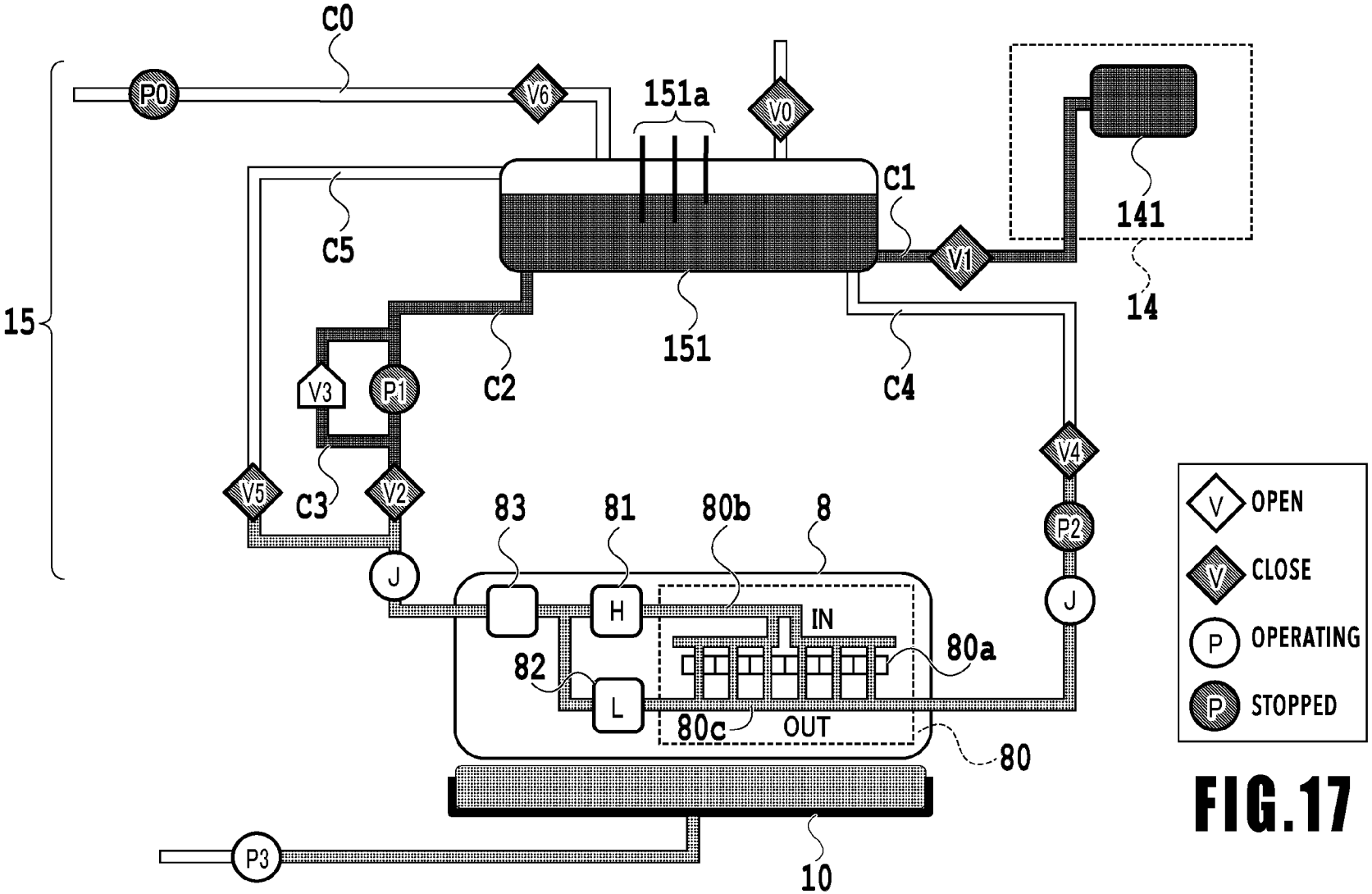
FIG. 17 is a diagram showing a state of the ink circulation system.

FIG. 17 is a diagram showing a state of the ink circulation system in which a negative pressure is generated in the cap unit 10. The space where a negative pressure is generated is indicated by light hatching. The space where a negative pressure is generated is the space of the flow paths from the cap unit 10 to the head replacement valve V5, the supply valve V2, and the collection valve V4, and includes the joint J. In a case where the joint J is released in the above state, even though ink exists on the connection surface of the joint J, the ink is absorbed into the flow paths due to the negative pressure.

Figure 18A:
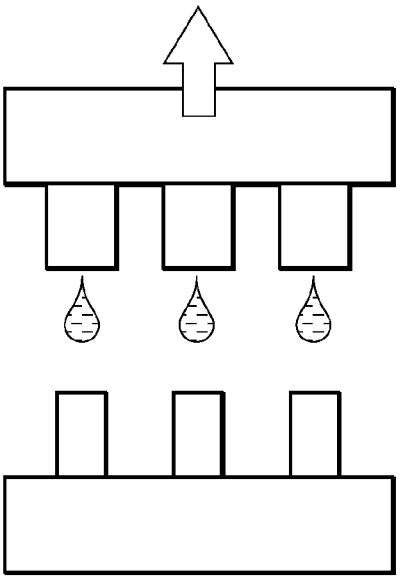
FIGS. 18A and 18B are diagrams for explaining an effect.
Figure 18B:
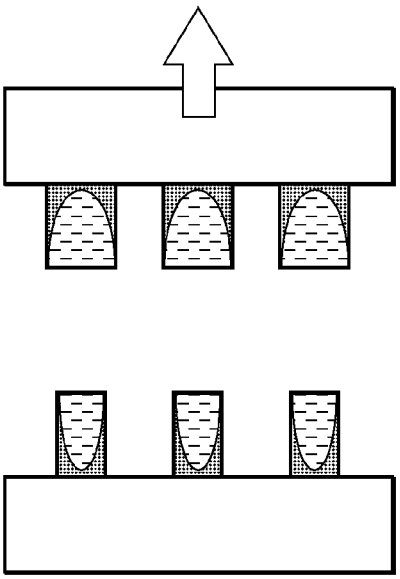

At Step S1607, the joint is released. The joint is released, for example, by a user. FIGS. 18A and 18B are diagrams for explaining the effect of the present embodiment. FIG. 18A is a diagram in a case where the connection of the joint J is released while ink remains in the vicinity of the joint J. In this case, ink drips from the surface where the connection of the joint J is released. On the other hand, FIG. 18B is a diagram in which the connection of the joint J is released while a negative pressure is generated in the joint J. In a case where the connection of the joint J is released, ink remaining in the vicinity of the joint J is absorbed into the flow paths. Therefore, it is possible to prevent ink from dripping.

Modification Example 1

Next, an explanation is given of a modification example of the second embodiment. In the mode as described above, an explanation has been given of a mode in which the vacuum pump P3 (i.e., intra-cap vacuum pump) that reduces pressure inside a cap is used as a negative pressure generating source for generating a negative pressure in the joint J. In the modification example, an explanation is given of a mode in which a negative pressure is generated in the joint J by use of the vacuum pump P0 (i.e., intra-tank vacuum pump) that reduces pressure in the sub-tank 151.

Figure 19:
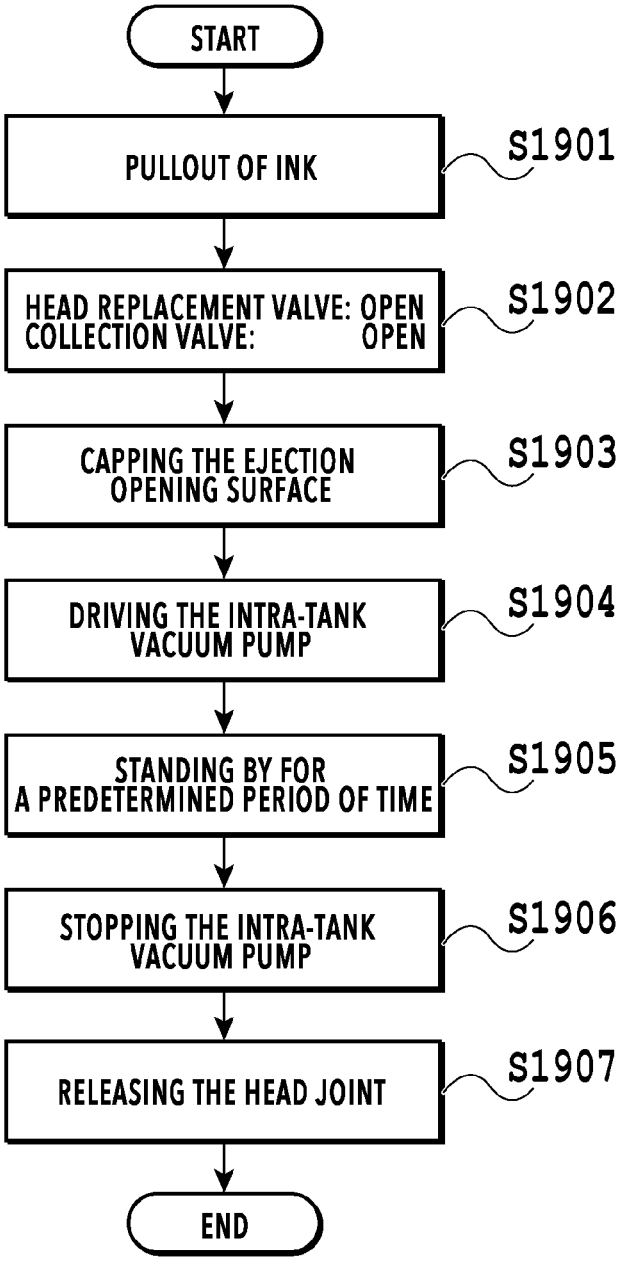
FIG. 19 is a diagram showing an example of a flowchart.

FIG. 19 is a diagram showing a flowchart of the modification example. Steps S1902, S1904, and S1906 are different as compared with the processing of FIG. 16. The different parts are explained below.

At Step S1902, the ink supply control unit 209 opens the head replacement valve V5 and the collection valve V4 (OPEN). At Step S1904, the ink supply control unit 209 generates a negative pressure by use of the vacuum pump P0 (i.e., intra-tank vacuum pump) that reduces pressure in the sub-tank 151. At Step S1906, the ink supply control unit 209 stops the vacuum pump P0.

Figure 20:
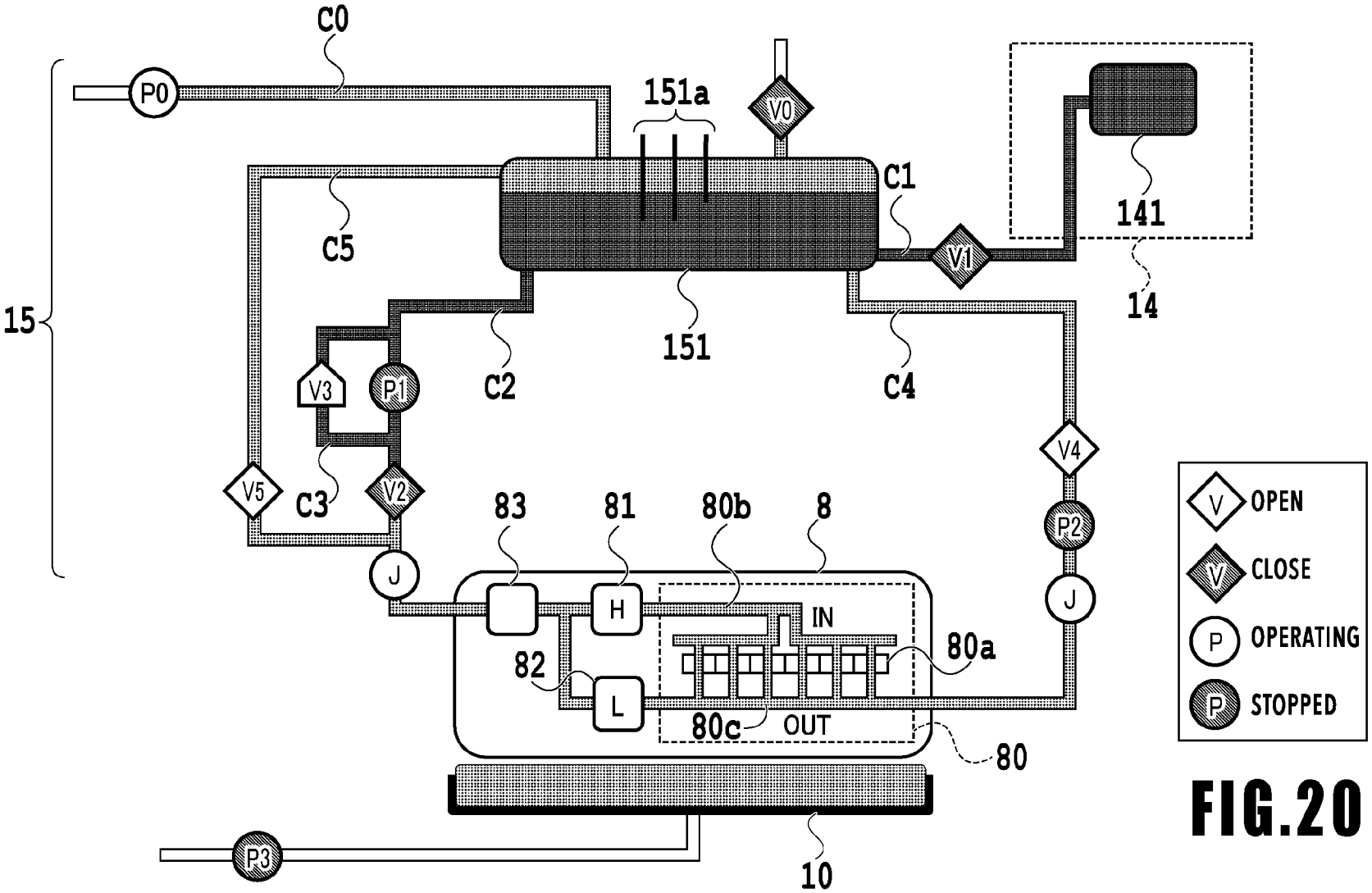
FIG. 20 is a diagram showing a state of the ink circulation system.

FIG. 20 is a diagram of a state in which a negative pressure is generated by driving of the vacuum pump P0 while the head unit 8 is capped by the cap unit 10 and while the head replacement valve V5 and the collection valve V4 are opened (OPEN). Since the head unit 8 is capped, the space inside the head unit 8 and inside the upstream flow path and the collection flow path C4, from which ink has been pulled out at Step S1901, is the space where a negative pressure is generated. That is, the space where a negative pressure is generated includes the joint J. In a case where the joint J is released in the above state, even though ink exists on the connection surface of the joint J, the ink is absorbed into the flow paths due to the negative pressure.

Modification Example 2

Next, an explanation is given of another modification example of the second embodiment. The mode of releasing the joint J while a negative pressure is generated in the cap unit 10 is the same as that explained in the second embodiment. In the present modification example, an explanation is given of a mode in which the vacuum pump for reducing pressure inside of the cap is the same single pump as the vacuum pump P0 for reducing pressure in the sub-tank 151.

Figure 21:
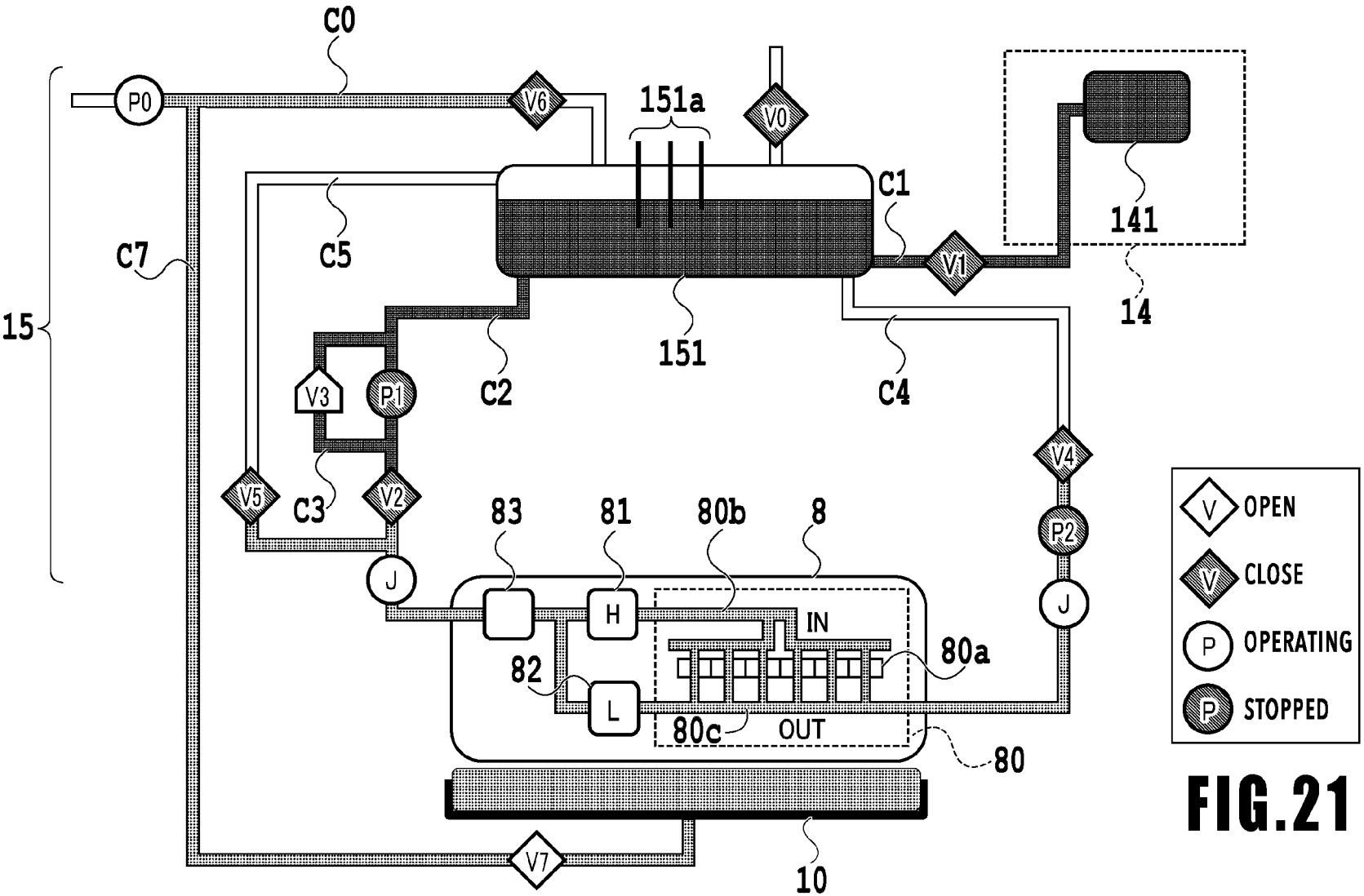
FIG. 21 is a diagram showing a state of the ink circulation system.

FIG. 21 is a diagram showing the state of the ink circulation system in the present modification example. The single vacuum pump P0 is capable of operating to reduce pressure in the sub-tank 151 and the cap unit 10. Here, a flow path C0, which connects the vacuum pump P0 and the sub-tank 151, and a flow path C7, which connects the vacuum pump P0 and the cap unit 10, are provided. Further, in the flow path C0 connecting to the sub-tank 151, a sub-tank vacuum valve V6 is provided. Further, in the flow path C7 connecting to the cap unit 10, a cap unit vacuum valve V7 is provided. In a case where the vacuum pump P0 is driven while the sub-tank vacuum valve V6 is opened and the cap unit vacuum valve V7 is closed by the ink supply control unit 209, the pressure in the sub-tank 151 is reduced. In a case where the vacuum pump P0 is driven while the cap unit vacuum valve V7 is opened and the sub-tank vacuum valve V6 is closed by the ink supply control unit 209, the pressure in the cap unit 10 is reduced. The example of FIG. 21 shows a case of generating a negative pressure in the cap. Specifically, the example of FIG. 21 shows a state in which the vacuum pump P0 is operated while the ejection opening surface 8*a* is capped by the cap unit 10. Further, the sub-tank vacuum valve V6 is closed, and the cap unit vacuum valve V7 is opened. As described above, the vacuum pump for reducing pressure inside the sub-tank 151 and the vacuum pump for reducing pressure in the head unit 8 may be the same pump.

(Ink Pullout Method Using Sub-Tank Vacuum Valve)

Figure 22:
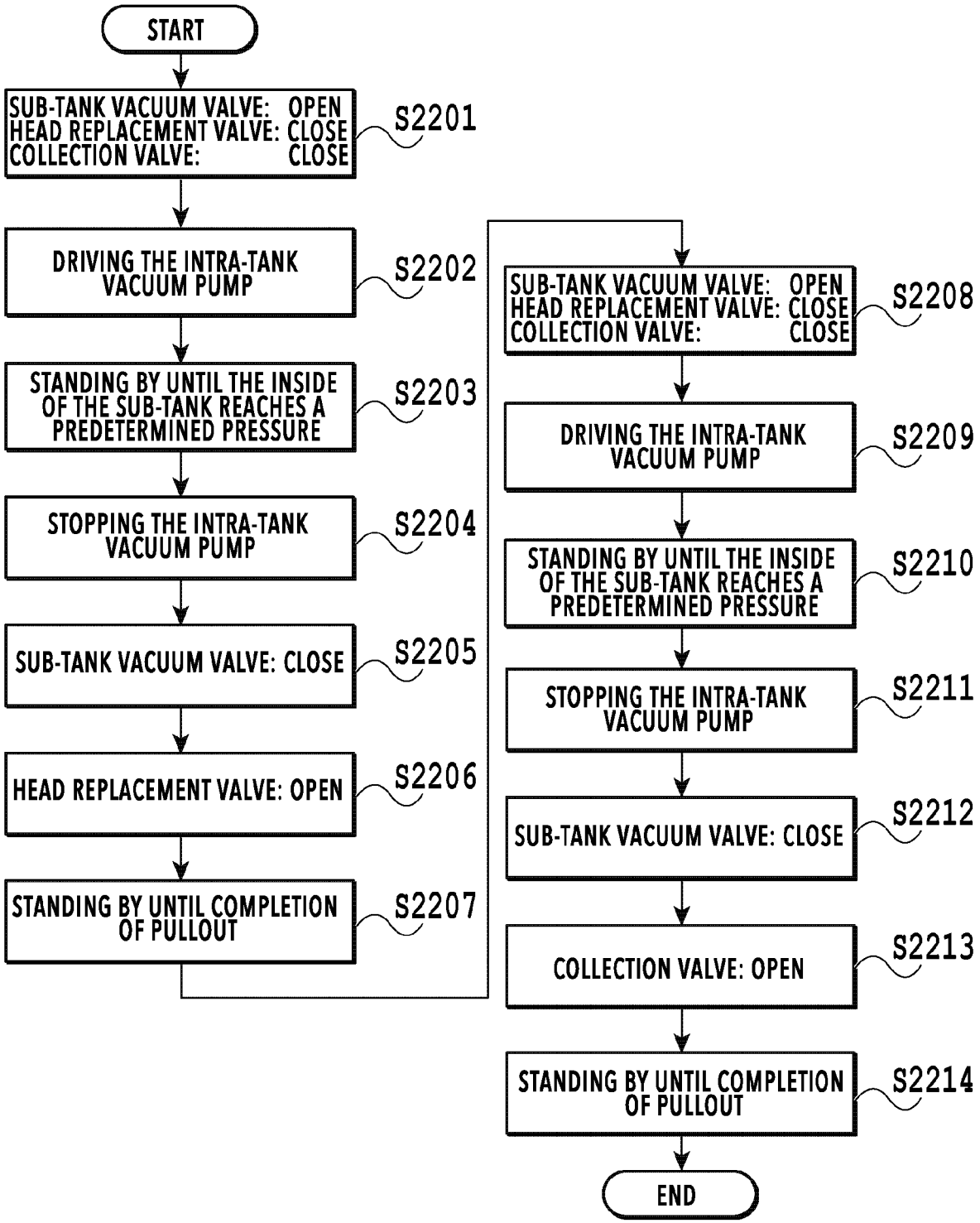
FIG. 22 is a diagram showing an example of a flowchart.

FIG. 22 is a flowchart showing an ink pullout method using the sub-tank vacuum valve V6, which can be applied to the first and second embodiments. With reference to FIG. 22, an explanation is given of an ink pullout method in a case where the sub-tank vacuum valve V6 is provided between the vacuum pump P0 and the sub-tank 151. First, at Step S2201, the ink supply control unit 209 opens the sub-tank vacuum valve V6 (OPEN). On the other hand, the collection valve V4 and the head replacement valve V5 are kept closed (CLOSE).

Then, at Step S2202, the ink supply control unit 209 drives the vacuum pump P0 (i.e., intra-tank vacuum pump) to generate a negative pressure in the sub-tank 151. The ink supply control unit 209 stands by until the inside of the sub-tank 151 reaches a predetermined negative pressure at Step S2203 and then stops the vacuum pump P0 at Step S2204. Accordingly, the closed space formed by the sub-tank vacuum valve V6, the head replacement valve V5, and the collection valve V4 reaches the predetermined negative pressure.

At Step S2205, the ink supply control unit 209 closes the sub-tank vacuum valve V6 (CLOSE) and subsequently opens the head replacement valve V5 (OPEN) at Step S2206. Accordingly, pulling out of ink on the upstream flow path side is initiated due to the negative pressure charged in the closed space. At Step S2207, the ink supply control unit 209 stands by for a predetermined period of time until pulling out of ink is completed. Through the above processing, pulling out of ink from a major part of the head unit 8 and a part of the upstream flow path side is completed.

Subsequently, at Step S2208, the ink supply control unit 209 closes the head replacement valve V5 and the collection valve V4 (CLOSE) and opens the sub-tank vacuum valve V6 (OPEN). Then, in the same manner as the upstream flow path side, the ink supply control unit 209 drives the vacuum pump P0 to generate a negative pressure in the sub-tank 151 at Step S2209. The ink supply control unit 209 stands by until the inside of the sub-tank 151 reaches a predetermined negative pressure at Step S2210 and then stops the vacuum pump P0 at Step S2211. Accordingly, the closed space formed by the sub-tank vacuum valve V6, the head replacement valve V5, and the collection valve V4 reaches the predetermined negative pressure.

At Step S2212, the ink supply control unit 209 closes the sub-tank vacuum valve V6 (CLOSE) and subsequently opens the collection valve V4 (OPEN) at Step S2213. Accordingly, pulling out of ink on the collection flow path C4 side (i.e., downstream flow path side) is initiated due to the negative pressure charged in the closed space. At Step S2214, the ink supply control unit 209 stands by for a predetermined period of time until pulling out of ink is completed. Through the above processing, pulling out of ink from the part of the ink remaining in the head unit 8 and the collection flow path is completed, and the flow is terminated.

In the case where the sub-tank vacuum valve V6 is provided and ink in the head unit 8, the upstream flow path, and the collection flow path C4 is pulled out as described above, the sub-tank vacuum valve V6 is closed after a predetermined negative pressure is charged in the sub-tank 151. There may be a case where bubbles are formed in the sub-tank 151 due to the atmosphere entered from the ejection opening surface 8*a* and the bubbles reach the upper surface of the sub-tank 151. Even in such a case, by closing the sub-tank vacuum valve V6, it is possible to prevent the bubbles from entering the downstream of the sub-tank vacuum valve V6 in the flow path C0.

According to the present disclosure, it is possible to properly pull out ink filled in a print head into an ink-tank.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2018-030838, filed Feb. 23, 2018, and No. 2018-168942, filed Sep. 10, 2018, which are hereby incorporated by reference herein in their entirety.

What is claimed is:

1. An inkjet printing apparatus comprising:

a print head provided with an ejection opening surface on which an ejection opening for ink is formed;

a tank configured to contain ink to be supplied to the print head;

a supply flow path configured to supply ink from the tank to the print head;

a collection flow path configured to collect ink from the print head to the tank;

a supply drive valve capable of opening and closing the supply flow path;

a collection drive valve capable of opening and closing the collection flow path;

an atmosphere release valve for releasing an inside of the tank to the atmosphere;

a vacuum pump configured to reduce pressure inside the tank; and a control unit configured to control the supply drive valve, the collection drive valve, the atmosphere release valve, and the intra tank, wherein the control unit performs a first operation and a second operation, the first operation causing the vacuum pump to operate while the collection drive valve and the atmosphere release valve are closed, so as to pull out ink in a flow path which extends from the ejection opening to the supply flow path into the tank, and the second operation causing the vacuum pump to operate while the supply drive valve and the atmosphere release valve are closed, so as to pull out ink in a flow path which extends from the ejection opening to the collection flow path into the tank.

2. The inkjet printing apparatus according to claim 1, wherein, in the first operation, the control unit causes the vacuum pump to operate while the supply drive valve, the atmosphere release valve, and the collection drive valve are closed, so as to reduce pressure inside the tank, and opens the supply drive valve after the tank reaches a predetermined negative pressure.

3. The inkjet printing apparatus according to claim 1, wherein, in the second operation, the control unit causes the vacuum pump to operate while the supply drive valve, the atmosphere release valve, and the collection drive valve are closed, so as to reduce pressure inside the tank, and opens the collection drive valve after the tank reaches a predetermined negative pressure.

4. The inkjet printing apparatus according to claim 1, wherein the control unit performs the second operation after the first operation or performs the first operation after the second operation.

5. The inkjet printing apparatus according to claim 4, wherein the control unit stops the vacuum pump after the first operation and the second operation.

6. The inkjet printing apparatus according to claim 1, further comprising:

a collection pump arranged in the collection flow path and configured to circulate ink such that ink passes through the supply flow path, the ejection opening, and the collection flow path, wherein the control unit further causes the collection pump to operate in the second operation.

7. The inkjet printing apparatus according to claim 1, further comprising:

a cap configured to cover the ejection opening;

a cap vacuum pump configured to reduce pressure inside the cap while the ejection opening surface is covered by the cap; and a connection unit configured to connect the print head to the supply flow path and the collection flow path, wherein, before releasing a connection of the print head to the supply flow path and the collection flow path, the control unit performs the first operation and the second operation, then closes the supply drive valve and the collection drive valve, and causes the cap vacuum pump to operate while the ejection opening is covered by the cap.

8. The inkjet printing apparatus according to claim 7, wherein the vacuum pump and the cap vacuum pump are the same pump.

9. The inkjet printing apparatus according to claim 1, further comprising:

a cap configured to cover the ejection opening surface;

a connection unit configured to connect the print head to the supply flow path and the collection flow path, wherein, before releasing a connection of the print head to the supply flow path and the collection flow path, the control unit performs the first operation and the second operation, then opens the supply drive valve and the collection drive valve, and causes the vacuum pump to operate while the ejection opening is covered by the cap.

10. The inkjet printing apparatus according to claim 2, further comprising:

a tank vacuum valve provided between the tank and the vacuum pump, wherein, in the first operation, the control unit causes the vacuum pump to operate while the supply drive valve, the atmosphere release valve, and the collection drive valve are closed, and the tank vacuum valve is opened, so as to reduce pressure inside the tank, then closes the tank vacuum valve and opens the supply drive valve after the tank reaches the predetermined negative pressure.

11. The inkjet printing apparatus according to claim 10, wherein, in the second operation, the control unit causes the vacuum pump to operate while the supply drive valve, the atmosphere release valve, and the collection drive valve are closed and the tank vacuum valve is opened, so as to reduce pressure inside the tank, then closes the tank vacuum valve and opens the collection drive valve after the tank reaches the predetermined negative pressure.

12. The inkjet printing apparatus according to claim 1, further comprising:

a circulation pump provided in a circulation flow path and configured to circulate ink in the circulation flow path in which ink is circulated so as to pass through the tank, the supply flow path, inside of the print head, and the collection flow path, wherein the vacuum pump is arranged in a different flow path from the circulation flow path.

13. An inkjet printing apparatus comprising:

a print head provided with an ejection opening surface on which an ejection opening for ink is formed;

a tank configured to contain ink to be supplied to the print head;

a supply flow path configured to supply ink from the tank to the print head;

a collection flow path configured to collect ink from the print head to the tank;

a supply drive valve capable of opening and closing the supply flow path;

a collection drive valve capable of opening and closing the collection flow path;

an intra-tank vacuum pump configured to reduce pressure inside the tank; and a control unit configured to control the supply drive valve, the collection drive valve, and the intra-tank vacuum pump;

wherein the inkjet printing apparatus further comprising:

a replacement flow path configured to allow an air chamber in the tank and the supply flow path to communicate with each other; and a replacement drive valve capable of opening and closing the replacement flow path, wherein the supply drive valve is provided in an upstream relative to a connection point of the supply flow path and the replacement flow path, and wherein the control unit performs a first operation and a second operation, the first operation causing the intra-tank vacuum pump to operate while the supply drive valve and the collection drive valve are closed, so as to pull out ink in a flow path which extends from the ejection opening to the replacement flow path into the tank, the second operation causing the intra-tank vacuum pump to operate while the supply drive valve and the replacement drive valve are closed, so as to pull out ink in a flow path which extends from the ejection opening to the collection flow path into the tank.

14. A control method of an inkjet printing apparatus including:

(a) a print head provided with an ejection opening surface on which an ejection opening for ink is formed; (b) a tank configured to contain ink to be supplied to the print head; (c) a supply flow path configured to supply ink from the tank to the print head; (d) a collection flow path configured to collect ink from the print head to the tank; (e) a supply drive valve capable of opening and closing the supply flow path; (f) an atmosphere release valve for releasing an inside of the tank to the atmosphere; (g) a collection drive valve capable of opening and closing the collection flow path; and (h) a vacuum pump configured to reduce pressure inside the tank, the control method comprising:

performing a first operation and a second operation, the first operation causing the vacuum pump to operate while the collection drive valve and the atmosphere release valve are closed, so as to pull out ink in a flow path which extends from the ejection opening to the supply flow path into the tank, and the second operation causing the vacuum pump to operate while the supply drive valve and the atmosphere release valve are closed, so as to pull out ink in a flow path which extends from the ejection opening to the collection flow path into the tank.

15. An inkjet printing apparatus comprising:

a print head provided with an ejection opening surface on which an ejection opening for ink is formed;

a tank configured to contain ink to be supplied to the print head;

a supply flow path configured to supply ink from the tank to the print head;

a collection flow path configured to collect ink from the print head to the tank;

a supply drive valve capable of opening and closing the supply flow path;

a collection drive valve capable of opening and closing the collection flow path;

a circulation pump provided in a circulation flow path and configured to circulate ink in the circulation flow path in which ink is circulated so as to pass through the tank, the supply flow path, inside of the print head, and the collection flow path;

a tank vacuum pump configured to reduce pressure inside the tank; and a control unit configured to control the supply drive valve, the collection drive valve, the circulation pump, and the tank vacuum pump, wherein the control unit performs a first operation and a second operation, the first operation causing the tank vacuum pump to operate while the collection drive valve is closed, so as to pull out ink in a flow path which extends from the ejection opening to the supply flow path into the tank, and the second operation causing the tank vacuum pump to operate while the supply drive valve is closed, so as to pull out ink in a flow path which extends from the ejection opening to the collection flow path into the tank, and wherein the tank vacuum pump is arranged in a different flow path from the circulation flow path.

* * * * *